US012698697B1

(12) United States Patent
Janwadkar et al.

(10) Patent No.: US 12,698,697 B1
(45) Date of Patent: Aug. 4, 2026

(54) SYSTEMS AND METHODS FOR INDEPENDENT CONTROL AND OPERATIONS OF TUBING AND ANNULUS AT THE WELLHEAD FOR STEAM INJECTION

(71) Applicant: Chevron U.S.A. Inc., San Ramon, CA (US)

(72) Inventors: Sandeep Shashikant Janwadkar, The Woodlands, TX (US); Jay Patrick Painter, League City, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/254,193

(22) Filed: Jun. 30, 2025

(51) Int. Cl.
*E21B 43/24* (2006.01)

(52) U.S. Cl.
CPC ..... *E21B 43/2406* (2013.01)

(58) Field of Classification Search
CPC ..... E21B 33/03; E21B 34/025; E21B 34/16; E21B 43/24; E21B 43/2406
See application file for complete search history.

(56) References Cited

U.S. PATENT DOCUMENTS 3,373,805 A * 3/1968 Boberg ..... E21B 36/00 166/57
4,537,254 A * 8/1985 Elson ..... E21B 43/086 166/371
4,685,522 A * 8/1987 Dixon ..... E21B 43/12 166/263
5,246,074 A * 9/1993 Ayres ..... E21B 37/06 166/310
12,163,396 B2 * 12/2024 Painter ..... E21B 33/035
2018/0051544 A1 * 2/2018 Franco ..... E21B 43/123
2024/0133261 A1 * 4/2024 Painter ..... E21B 33/04
2024/0229589 A9 * 7/2024 Painter ..... E21B 33/035

FOREIGN PATENT DOCUMENTS

BR PI1105806 A2 * 12/2015 ..... E21B 43/24
CN 114991716 A * 9/2022 ..... E21B 34/02

* cited by examiner

*Primary Examiner* — Jennifer H Gay
(74) *Attorney, Agent, or Firm* — Smith & Woldesenbet Law Group, PLLC

(57) ABSTRACT

A method for utilizing steam for enhanced subterranean production may include operating multiple flow control valves of a wellhead assembly at a wellbore into a configuration so that a flow path is opened, where a first end of the flow path is configured to be coupled to a steam injection system, and where a second end of the flow path is configured to be coupled to the wellbore that extends into a subterranean formation. The method may also include maintaining the configuration of the flow control valves for a time period, where the flow control valves and associated piping are configured to operate under a pressure, a temperature, and a flow rate present with injecting the steam for the time period, and where the flow control valves and associated piping are further configured to operate under a pressure, a temperature, and a flow rate present with producing a production fluid.

19 Claims, 17 Drawing Sheets

SYSTEMS AND METHODS FOR INDEPENDENT CONTROL AND OPERATIONS OF TUBING AND ANNULUS AT THE WELLHEAD FOR STEAM INJECTION

TECHNICAL FIELD

The present application is related to wellheads and, more particularly, to independent control and operations of the tubing and annulus at the wellhead for steam injection.

BACKGROUND

In order to inject steam into and/or produce the tubing and/or the annulus between the tubing and casing, significant time and expense must be expended to transition between such operations. When a subterranean resource being produced from a wellbore includes heavy oils, steam is injected down the wellbore to stimulate production. In such cases, steam is injected down the tubing or the annulus, which limits the cross-sectional flow area available for steam injection, which restricts the rate (e.g., in barrels of steam per day) of steam injection. The reduced rate of steam injection results in more time (e.g., in days) for the same amount of heat to be transferred to the reservoir. More days of steam injection proportionately reduces the number of days that the well can be put on production. A delay in production results in lost revenue due to more days for the well to produce the same amount of hydrocarbons. Also, switching between injection through the tubing and injection through the annulus requires switching piping, connections, and special equipment, all of which costs time and money.

SUMMARY

In general, in one aspect, the disclosure relates to a method for utilizing steam for enhanced subterranean production. The method may include operating a plurality of flow control valves of a wellhead assembly at a wellbore into a first configuration so that a first flow path of a plurality of flow paths is opened, where the first flow path includes a first end and a second end, where the first end of the first flow path is configured to be coupled to a steam injection system, and where the second end of the first flow path is configured to be coupled to the wellbore that extends into a subterranean formation. The method may also include maintaining the first configuration of the plurality of flow control valves for a first time period, where the plurality of flow control valves and associated piping are configured to operate under a steam pressure, a steam temperature, and a steam flow rate present with injecting the steam for the first time period, and where the plurality of flow control valves and associated piping are further configured to operate under a production fluid pressure, a production fluid temperature, and a production fluid flow rate present with producing production fluid.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF THE INVENTION

Figure 1:
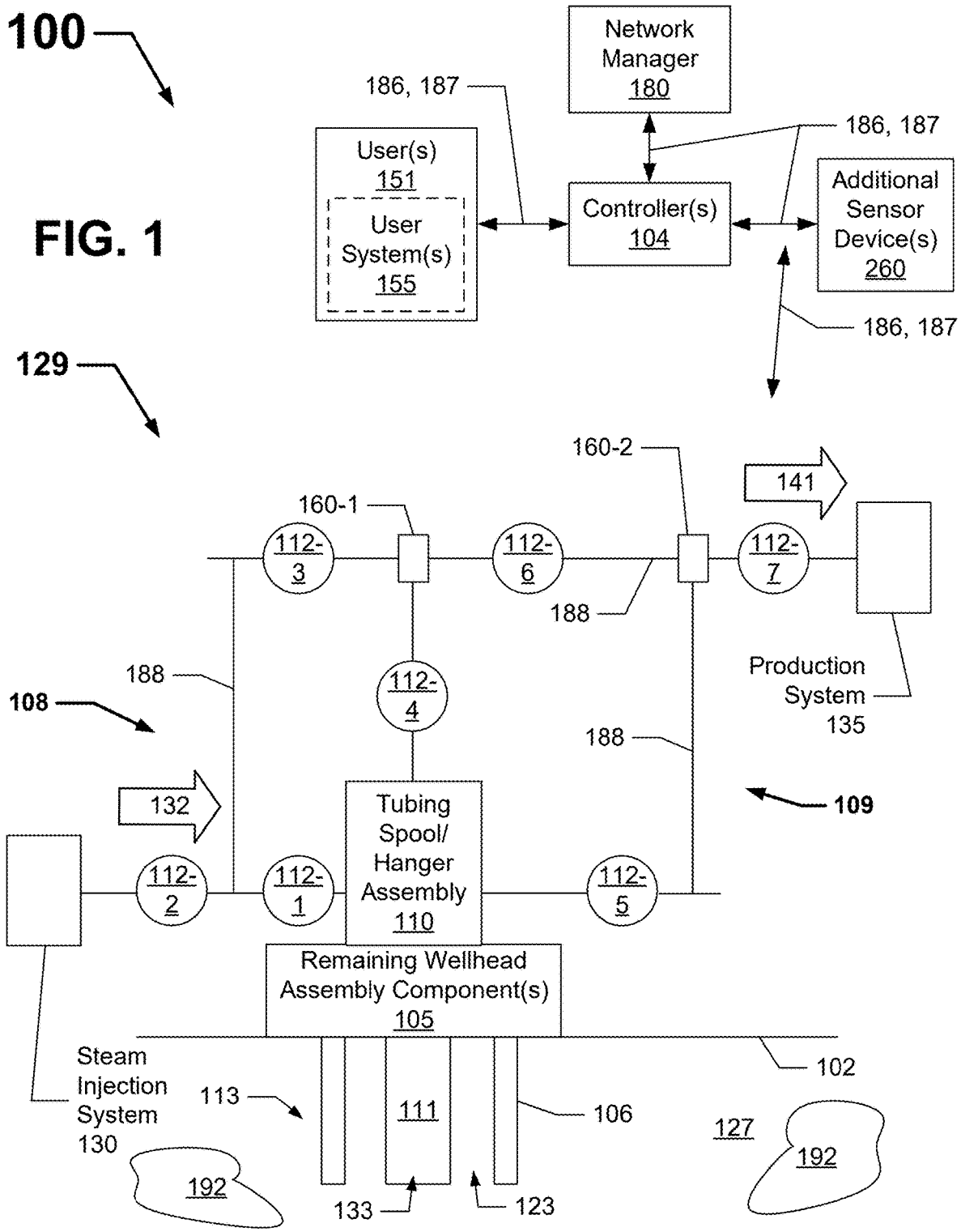
FIG. 1 shows a system that includes a wellhead assembly according to certain example embodiments.

The example embodiments discussed herein are directed to systems, apparatuses, methods, and devices for independent control and operations of the tubing and annulus at the wellhead for steam injection. Put another way, example embodiments discussed herein are directed to systems, apparatuses, methods, and devices for utilizing steam for enhanced subterranean production. Example embodiments can be used in wellhead assemblies for subterranean field operations (e.g., injection operations, production operations). Example embodiments are configured to safely allow for the independent control and subterranean field operations through the tubing and the annulus between the tubing and the production casing at the wellhead assembly. Example embodiments can be used for wellhead assemblies in both land-based and offshore subterranean operations. While example embodiments are described as being used in conjunction with tubing spools herein, example embodiments can be used, in full or in part, in conjunction with other components of a wellhead assembly.

A wellhead assembly that includes example embodiments can include one or multiple components, where a component can be made from a single piece (as from a mold or an extrusion or a three-dimensional printing process). When a component (or portion thereof) of a wellhead assembly that includes example embodiments is made from a single piece, the single piece can be cut out, bent, stamped, and/or otherwise shaped to create certain features, elements, or other portions of the component. Alternatively, a component (or portion thereof) of a wellhead assembly that includes example embodiments can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Wellhead assemblies that use example embodiments can be designed to comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Each component of a wellhead assembly (including portions thereof) can be made of one or more of a number of suitable materials, including but not limited to metal (e.g., stainless steel), ceramic, rubber, glass, fibrous material, and plastic.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of independent control and operations of the tubing and annulus at the wellhead for steam injection will be described more fully hereinafter with reference to the accompanying drawings, in which example embodiments of independent control and operations of the tubing and annulus at the wellhead for steam injection are shown. Independent control and operations of the tubing and annulus at the wellhead for steam injection may, however, be embodied in many different forms and should not be construed as limited to the example embodiments set forth herein. Rather, these example embodiments are provided so that this disclosure will be thorough and complete, and will fully convey the scope of independent control and operations of the tubing and annulus at the wellhead for steam injection to those of ordinary skill in the art. Like, but not necessarily the same, elements (also sometimes called components) in the various figures are denoted by like reference numerals for consistency.

Terms such as "first", "second", "outer", "inner", "top", "bottom", "above", "below", "distal", "proximal", "front,", "rear," "left," "right," "on", and "within", when present, are used merely to distinguish one component (or part of a component or state of a component) from another. This list of terms is not exclusive. Such terms are not meant to denote a preference or a particular orientation, and they are not meant to limit embodiments of independent control and operations of the tubing and annulus at the wellhead for steam injection. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a system 100 that includes a wellhead assembly 129 according to certain example embodiments. In this case, in addition to the wellhead assembly 129, the system 100 includes one or more users 151 (which can each include one or more user systems 155), one or more controllers 104, a network manager 180, one or more additional sensor devices 260, a steam injection system 130, a production system 135, and a wellbore 113 in a subterranean formation 127. The wellhead assembly 129 of the system 100 can include multiple valves 112 (e.g., valve 112-1, valve 112-2), multiple sensor devices 160 (e.g., sensor device 160-1, sensor device 160-2), piping 188, the tubing spool/hanger assembly 110, and one or more remaining wellhead assembly components 105. The tubing spool/hanger assembly 110 includes a tubing hanger housed within a tubing spool. An example of a tubing spool/hanger assembly 110 is shown in more detail below with respect to FIGS. 2 and 3. The wellbore 113 has a production casing 106, inside of which is positioned a tubing string 111 (sometimes referred to herein as tubing). The tubing string 111 has a cavity 133 that extends continuously along its length, and there is an annulus 123 between the tubing string 111 and the production casing 106 that extends continuously along its length.

The components shown in FIG. 1 are not exhaustive, and in some embodiments, one or more of the components shown in FIG. 1 may not be included in a wellhead assembly in which the example tubing spool/hanger assembly 110 can be used. Any component of the wellhead assembly 129 can be discrete or combined with one or more other components of the wellhead assembly 129. Also, one or more components of the wellhead assembly 129 can have different configurations.

When the subterranean resource 192 being extracted from a subterranean formation 127 is a heavy oil and/or some other resource with a relatively high viscosity, extraction of that subterranean resource 192 can be difficult. In order to make such subterranean resource 192 easier to be produced from the subterranean formation 127, one or more field operations are performed by lower the viscosity of the subterranean resource 192. One such field operation is to inject steam 132 down the wellbore 113.

However, as discussed above, the current art presents limitations with this approach. For example, special wellhead equipment that is configured to handle the temperatures, pressures, and flow rates of the steam 132 at the surface 102 so that the steam 132 can effectively penetrate the fractures in the subterranean formation 127 and interact with the subterranean resources 192 in a manner sufficient to lower the viscosity of the subterranean resources 192 must be installed for the field operation, and subsequently removed and replaced with the standard wellhead equipment when injection of the steam 132 has concluded. This results in a loss in time, higher expenses for the extra equipment, and puts personnel at potential risk for changing the equipment.

Another limitation with the current art in this scenario is that only a limited amount of steam 132 (limited by the size of the cavity 133 of the tubing string 111 or limited by the size of the annulus 123) may be injected into the wellbore 113 at a time. In other words, the cross-sectional flow area available for injection of the steam 132 is relatively limited, and this restricts the rate (e.g., in barrels of steam 132 per day) of injection. The reduced rate of injection of the steam 132 results in more time (e.g., in days) for some amount of heat to be transferred to the subterranean resource 192 within the subterranean formation 127. More days of injection of the steam 132 proportionately reduces the number of days that the wellbore 113 can be put on production. A delay in production results in lost revenue due to more days for the wellbore 113 to produce the same amount of subterranean resource 192.

Example embodiments overcome these limitations by allowing for the steam 132 to be injected down the cavity 133 of the tubing string 111 and the annulus 123 at the same time, by using equipment that is suitable for both injection of steam 132 and extraction of the production fluids 141 (whether at the same time or at different times), and by allowing for a change in operations through a change in the configuration of the wellhead assembly 129 with substantially little or no down time.

The tubing spool/hanger assembly 110 of the wellhead assembly 129 is configured to support the tubing string 111. Generally, the tubing spool/hanger assembly 110 is positioned toward the top of the wellhead assembly 129. The tubing spool/hanger assembly 110 can have any of a number of configurations (e.g., mating threads, recesses) and/or components (e.g., pins) to support the tubing string 111 while also incorporating a sealing system to ensure that the cavity 133 within the tubing string 111 and the annulus 123 between the tubing string 111 and the production casing 106 are hydraulically isolated from each other. Once the wellbore 113 is drilled, the production casing 106 is inserted into the wellbore 113 to stabilize the wellbore 113 and allow for the extraction of subterranean resources (e.g., natural gas, oil) from the subterranean formation 127. The production casing 106 is often secured to the subterranean formation 127 using cement in an intermediate field operation.

The tubing spool/hanger assembly 110 can be coupled, directly or indirectly, to one or more remaining wellhead assembly components 105. Examples of such remaining wellhead assembly components 105 can include, but are not limited to, a tubing head, and a casing hanger. At least one component (e.g., a remaining wellhead assembly component 105) of the wellhead assembly 129 can be positioned at the surface 102. Below the surface 102 is the subterranean formation 127. Within the subterranean formation 127 is one or more (in this case, one) wellbores 113. In some cases, the surface 102 is under water (e.g., a seabed). In such cases, the wellhead assembly 129 can be located in the water.

The tubing spool/hanger assembly 110 can also be coupled directly to piping 188. The piping 188 can include multiple pipes, ducts, elbows, joints, sleeves, collars, and similar components that are coupled to each other (e.g., using coupling features such as mating threads) to establish a network for transporting one or more fluids (e.g., steam 132, a production fluid 141) at different times. Each component of the piping 188 can have an appropriate size (e.g., inner diameter, outer diameter) and be made of an appropriate material (e.g., steel, PVC) to safely and efficiently handle the pressure, temperature, flow rate, acidity, and other characteristics of the fluids that can flow therethrough.

The wellhead assembly 129 may include an injection portion 108 and a production portion 109. The injection portion 108 includes valve 112-1, valve 112-2, valve 112-3, valve 112-4, and the piping 188 that provides fluidic communication between these valves 112, the steam injection system 130, and the tubing spool/hanger assembly 110. The production portion 109 includes valve 112-4, valve 112-5, valve 112-6, valve 112-7, and the piping 188 that provides fluidic communication between these valves 112, the production system 135, and the tubing spool/hanger assembly 110. In this way, the valve 112-4 is part of the injection portion 108 and the production portion 109.

Each of the valves 112 (also sometimes referred to a flow control valves 112 herein) can be placed in-line with the piping 188 at various locations in the wellhead assembly 129 of the system 100 to control the flow of one or more fluids at a given point in time. A valve 112 can have one or more of any of a number of configurations, including but not limited to a guillotine valve, a ball valve, a gate valve, a butterfly valve, a pinch valve, a needle valve, a plug valve, a diaphragm valve, and a globe valve. One valve 112 can be configured the same as or differently compared to another valve 112 in the wellhead assembly 129 of the system 100. Also, one valve 112 can be controlled (e.g., manually, automatically by the controller 104) the same as or differently compared to another valve 112 in the wellhead assembly 129 of the system 100.

As discussed above, the wellhead assembly 129 of the system 100 can include one or more valves 112. For example, in this case, the wellhead assembly 129 includes 7 valves 112 (valve 112-1, valve 112-2, valve 112-3, valve 112-4, valve 112-5, valve 112-6, and valve 112-7). Each valve 112 has a fully open position that allows a fluid to flow uninhibited therethrough and a fully closed position that prevents any fluid from flowing therethrough. In some cases, a valve 112 can also have any of a number of other positions (half open, a quarter closed, a quarter open) between fully open and fully closed that inhibit some amount of fluid flowing therethrough. Such other positions of a valve 112 can be discrete or continuous.

One end of valve 112-1 is coupled to piping 188 that is directly coupled to a side end (e.g., similar to the side end 239-2 of FIGS. 2 and 3 below, similar to the side end 1539-2 of FIG. 15 below) of a channel (e.g., similar to the channel 234 of FIGS. 2 and 3 below, similar to the channel 1534 of FIG. 15 below) of the tubing spool/hanger assembly 110. The other end of valve 112-1 is coupled to piping 188 that is directly coupled to one end of valve 112-2 and to one end of valve 112-3. The other end of valve 112-2 is coupled to piping 188 that is directly coupled to the steam injection system 130. The other end of valve 112-3 is coupled to piping 188 that is directly coupled to one end of valve 112-4 and to one end of valve 112-6. The other end of valve 112-4 is coupled to piping 188 that is directly coupled to the top end of a channel (in communication with the cavity 133 of the tubing string 111 when the tubing string 111 is coupled to the tubing spool/hanger assembly 110) of the tubing spool/hanger assembly 110.

The other end of valve 112-6 is coupled to piping 188 that is directly coupled to one end of valve 112-7 and to one end of valve 112-5. The other end of valve 112-5 is coupled to piping 188 that is directly coupled to piping 188 that is directly coupled to a side end (similar to the side end 239-1 discussed below with respect to FIGS. 2 and 3) of a channel (in communication with the annulus 123 when the tubing string 111 and the production casing 106 are coupled to the tubing spool/hanger assembly 110) of the tubing spool/hanger assembly 110. The other end of valve 112-7 is coupled to piping 188 that is directly coupled to the production system 135. In alternative embodiments, the wellhead assembly 129 can have additional valves 112 (e.g., two valves 112 in series instead of a single valve 112), a different piping configuration, a different number of sensor devices 160, a different location of the sensor devices 160, etc.

The valves 112, piping 188, and other components of the example wellhead assembly 129 (as well as other embodiments of example wellhead assemblies discussed herein) are configured to operate under a pressure, a temperature, a flow rate, and/or other conditions present with injecting steam 132 for some period of time (e.g., hours, days, weeks, months) during an injection operation. In addition, the valves 112, piping 188, and other components of the example wellhead assembly 129 (as well as other embodiments of example wellhead assemblies discussed herein) are configured to operate under a pressure, a temperature, a flow rate, and/or other conditions present with producing produced fluids 141 for some period of time (e.g., hours, days, weeks, months) during a production operation. In this way, all of the components of the wellhead assembly 129 may be used for injection of steam 132 and/or production of produced fluids 141 without changing out any of the components of the wellhead assembly 129.

In certain example embodiments, the wellhead assembly 129 includes one or more sensor devices 160. Each sensor device 160 includes one or more sensors that measure one or more parameters (e.g., pressure, flow rate, temperature, fluid content, permeability, voltage, current, porosity, rock characteristics, chemical elements in a fluid, chemical elements in a solid). Examples of a sensor of a sensor device 160 can include, but are not limited to, a temperature sensor, a flow sensor, a pressure sensor (e.g., a pressure transducer), a gas spectrometer, a voltmeter, an ammeter, a permeability meter, a porosimeter, and a camera.

A sensor device 160 can be configured to measure one or more parameters of a fluid flowing through that part of the wellhead assembly 129. For example, a sensor device 160 can be configured to measure a parameter (e.g., flow rate, pressure, temperature) of a fluid flowing through the piping 188 at a particular location (e.g., between valve 112-3, valve 112-4, and valve 112-6) in the wellhead assembly 129. In this example, the wellhead assembly 129 includes two sensor devices 160. Sensor device 160-1 is located between valve 112-3, valve 112-4, and valve 112-6. Sensor device 160-2 is located between valve 112-5, valve 112-6, and valve 112-7. In some cases, a sensor device 160 may be configured to determine the extent to which a valve 112 within the wellhead assembly 129 is open or closed. In addition, or in the alternative, a sensor device 160 may be configured to determine the flow rate, temperature, pressure, and/or other parameter associated with a fluid (e.g., steam 132, production fluid 141) flowing through the piping 188.

The steam injection system 130 of the system 100 is configured to provide steam 132 to the wellhead assembly 129 for injection into the wellbore 113. Injecting steam 132 into the wellbore 113 can increase pressure within the subterranean formation 127, which can enhance recovery of a subterranean resource (e.g., oil, natural gas) from the subterranean formation 127. The steam injection system 130 can include one or more of any of a number of pieces of equipment. Examples of such equipment can include, but is not limited to, a motor, a pump, a compressor, a controller (similar to a controller 104), a sensor device 160, piping (similar to piping 188), a valve (similar to a valve 112), a storage tank, a gasket, and a mixing apparatus. Some or all of the steam injection system 130 can be located at or near the surface 102 and/or above the surface 102. Also, some or all of the steam injection system 130 can be located proximate to the wellhead assembly 129 and/or away from the wellhead assembly 129.

The production system 135 of the system 100 is configured to collect and extract one or more production fluids 141 (e.g., water, a subterranean resource) from the subterranean formation 127 through the wellbore 113. The production system 135 can include one or more of any of a number of pieces of equipment. Examples of such equipment can include, but is not limited to, a motor, a pump, a compressor, a controller (similar to a controller 104), a sensor device 160, piping (e.g., similar to piping 188, a pipeline), a valve (similar to a valve 112), a collection tank, a gasket, and a mixing apparatus. Some or all of the production system 135 can be located at or near the surface 102 and/or above the surface 102. Also, some or all of the production system 135 can be located proximate to the wellhead assembly 129 and/or away from the wellhead assembly 129.

As stated above, the system 100 can include one or more controllers 104. A controller 104 of the system 100 communicates with and in some cases controls one or more of the other components (e.g., a sensor device 160, an additional sensory device 260, the steam injection system 130, the production system 135) of the system 100. A controller 104 performs a number of functions that include obtaining and sending data, evaluating data, following protocols, running algorithms, and sending commands. A controller 104 can include one or more of a number of components. Such components of a controller 104 can include, but are not limited to, a control engine, a communication module, a timer, a counter, a power module, a storage repository, a hardware processor, memory, a transceiver, an application interface, and a security module. When there are multiple controllers 104 (e.g., one controller 104 for the steam injection system 130, another controller 104 for the production system 135, yet another controller 104 for sensor device 160-1), each controller 104 can operate independently of each other. Alternatively, one or more of the controllers 104 can work cooperatively with each other. As yet another alternative, one of the controllers 104 can control some or all of one or more other controllers 104 in the system 100.

Each sensor device 260 can be substantially the same as the sensor devices 160 discussed above that are integrated with the wellhead assembly 129. For example, each sensor device 260 can include one or more sensors that measure one or more parameters (e.g., pressure, flow rate, temperature, humidity, fluid content, voltage, current, permeability, porosity, rock characteristics, chemical elements in a fluid, chemical elements in a solid). Examples of a sensor of a sensor device 260 can include, but are not limited to, a temperature sensor, a flow sensor, a pressure sensor, a gas spectrometer, a voltmeter, an ammeter, a permeability meter, a porosimeter, and a camera. A sensor device 260 can be integrated with or measure a parameter associated with one or more components of the system 100. For example, a sensor device 260 can be configured to measure a parameter (e.g., flow rate, pressure, temperature, gas composition) of a gas used in the steam injection system 130.

In some cases, a number of sensor devices (e.g., sensor devices 160, sensor devices 260), each measuring a different parameter and/or the same parameter at different locations in the system 100, can be used in combination to determine and confirm whether a controller 104 should take a particular action (e.g., operate a valve 112, operate or adjust the operation of the production system 135). In some cases, a sensor device (e.g., sensor device 160, sensor device 260) includes its own controller 104 (or portions thereof).

A user 151 can be any person that interacts, directly or indirectly, with a controller 104 and/or any other component of the system 100. Examples of a user 151 can include, but are not limited to, a business owner, an engineer, a company representative, a geologist, a consultant, a drilling engineer, a contractor, and a manufacturer's representative. A user 151 can use one or more user systems 155, which may include a display (e.g., a GUI). A user system 155 of a user 151 can interact with (e.g., send data to, obtain data from) a controller 104 via an application interface and using the communication links 186. The user 151 can also interact directly with a controller 104 through a user interface (e.g., keyboard, mouse, touchscreen).

The network manager 180 is a device or component that controls all or a portion (e.g., a communication network, a controller 104) of the system 100. The network manager 180 can be substantially similar to a controller 104, as described above. For example, the network manager 180 can include a controller that has one or more components and/or similar functionality to some or all of a controller 104. Alternatively, the network manager 180 can include one or more of a number of features in addition to, or altered from, the features of a controller 104. As described herein, control and/or communication with the network manager 180 can include communicating with one or more other components of the same system 100 or another system. In such a case, the network manager 180 can facilitate such control and/or communication. The network manager 180 can be called by other names, including but not limited to a master controller, a network controller, and an enterprise manager.

Interaction between each controller 104, the sensor devices (sensor devices 160, sensor devices 260), the users 151 (including any associated user systems 155), the network manager 180, and other components (e.g., the valves 112, the steam injection system 130, the production system 135) of the system 100 can be conducted using communication links 186 and/or power transfer links 187. Each communication link 186 can include wired (e.g., Class 1 electrical cables, Class 2 electrical cables, electrical connectors, Power Line Carrier, RS485) and/or wireless (e.g., Wi-Fi, Zigbee, visible light communication, wave energy, pulse energy, cellular networking, Bluetooth, Bluetooth Low Energy (BLE), ultrawide band (UWB), WirelessHART, ISA100) technology. A communication link 186 can transmit signals (e.g., communication signals, control signals, data) between each controller 104, the sensor devices (sensor devices 160, sensor devices 260), the users 151 (including any associated user systems 155), the network manager 180, and the other components of the system 100.

Each power transfer link 187 can include one or more electrical conductors, which can be individual or part of one or more electrical cables. In some cases, as with inductive power, power can be transferred wirelessly using power transfer links 187. A power transfer link 187 can transmit power between each controller 104, the sensor devices (sensor devices 160, sensor devices 260), the users 151 (including any associated user systems 155), the network manager 180, and the other components of the system 100. Each power transfer link 187 can be sized (e.g., 12 gauge, 18 gauge, 4 gauge) in a manner suitable for the amount (e.g., 480V, 24V, 120V) and type (e.g., alternating current, direct current) of power transferred therethrough.

Figure 2:
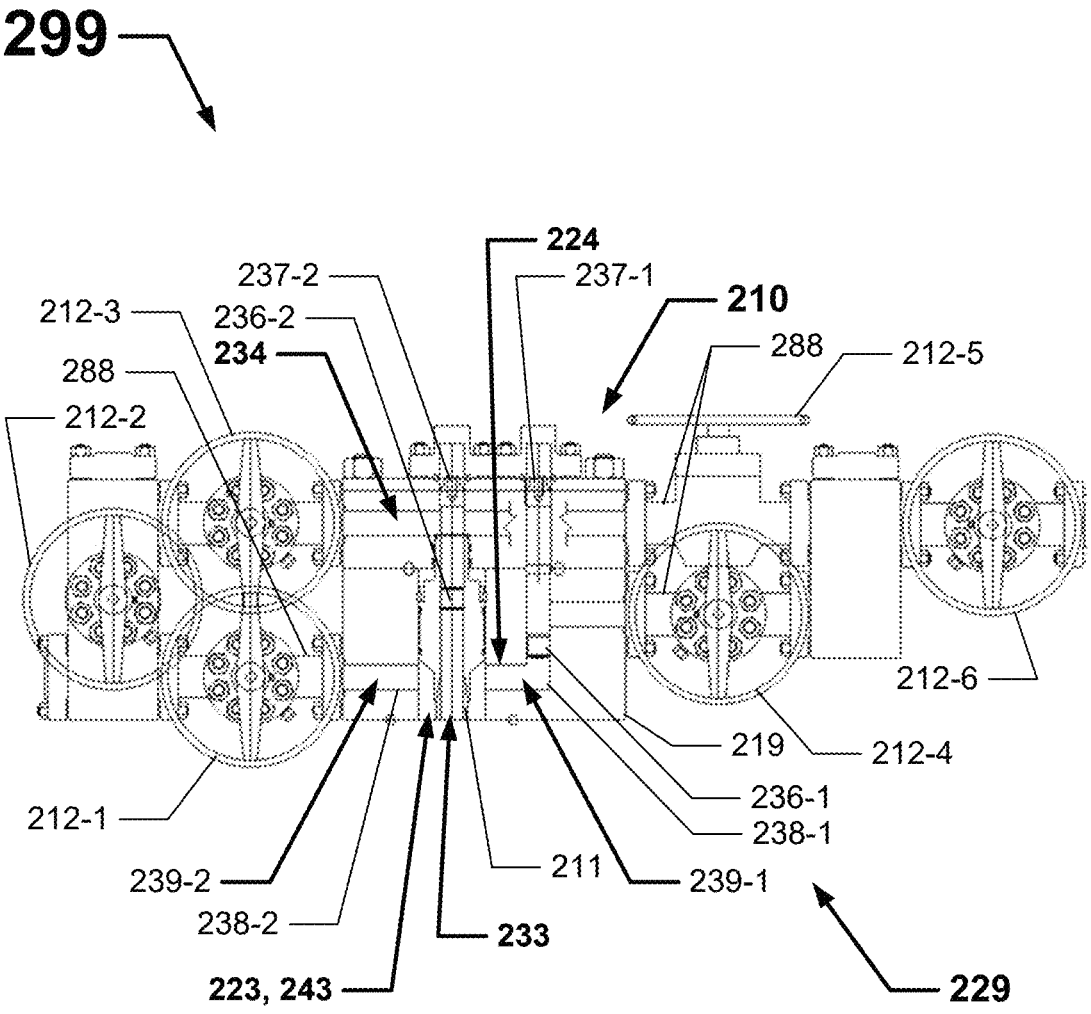
FIG. 2 shows a sectional view of a subassembly that includes a tubing spool/hanger assembly 210 according to certain example embodiments.
Figure 3:
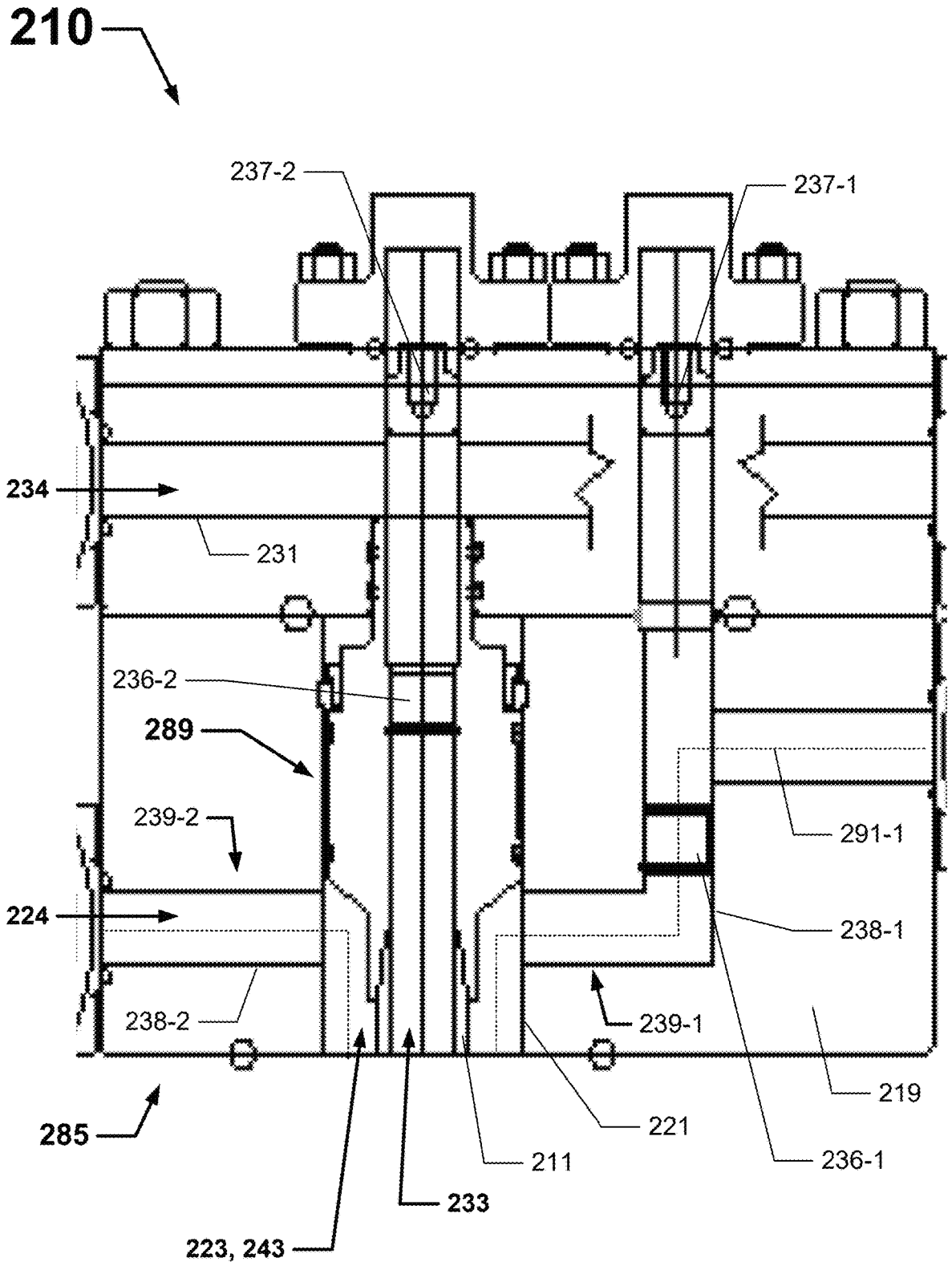
FIG. 3 shows a detailed sectional view of the tubing spool/hanger assembly of FIG. 2 according to certain example embodiments.

FIG. 2 shows a sectional view of a subassembly 299 that includes a tubing spool/hanger assembly 210 according to certain example embodiments. FIG. 3 shows a detailed sectional view of the tubing spool/hanger assembly 210 of FIG. 2. Referring to the description above with respect to FIG. 1, the subassembly 299 of FIG. 2 includes a wellhead assembly 229 that includes the tubing spool/hanger assembly 210, the top part of a tubing string 211, piping 288, and six valves 212 (valve 212-1, valve 212-2, valve 212-3, valve 212-4, valve 212-5 and valve 212-6). The tubing spool/hanger assembly 210 includes a tubing spool 285 and a tubing hanger 289. The wellhead assembly 229, the tubing spool/hanger assembly 210, the tubing string 211, and the valves 212 (also sometimes referred to as flow control valves 212 herein) of FIG. 3 can be substantially the same as the wellhead assembly 129, the tubing spool/hanger assembly 110, the tubing string 111, the piping 188, and the valves 112 discussed above with respect to FIG. 1, except as described below.

In this case, the tubing spool/hanger assembly 210 is part of the wellhead assembly 229. The tubing hanger 289 of the tubing spool/hanger assembly 210 is substantially the same as tubing hangers currently known in the art. The tubing hanger 289 is configured to be positioned within a cavity 243 disposed in the bottom middle of the body 219 of the example tubing spool 285. The cavity 243 of the tubing spool 285 is defined by a wall 221 of the body 219. The tubing hanger 289 couples to and supports the tubing string 211. The tubing hanger 289 has a cavity 233 that runs continuously through the tubing hanger 289 along the height of the tubing hanger 289. The cavity 233 has a diameter that is substantially the same as the inner diameter of the tubing string 211. The top end of the cavity 233 of the tubing hanger 289 is configured to be in communication with a channel 224 disposed in the body 219 of the example tubing spool 285.

The example tubing spool 285 of the tubing spool/hanger assembly 210 has a body 219 with two channels (channel 234 and channel 224) and the cavity 243 disposed therein. Channel 234 within the body 219 of the tubing spool 285 intersects with the top end of the tubing hanger 289 and the cavity 233 that traverses therethrough. The channel 234 is substantially horizontal and crosses through the body 219 near the top end of the tubing spool 285. The channel 234 is defined by one or more walls 231 in the body 219. The channel 234 is substantially cylindrical in shape along its length, and so there is one wall 231 that defines the channel 234.

In alternative embodiments, the channel 234 can have one or more different characteristics compared to what is shown and described in FIGS. 2 and 3. For example, the channel 234 can have one or more cross-sectional shapes along its length in alternative embodiments. As another example, some or all of the channel 234 can have an orientation other than horizontal. As yet another example, the channel 234 can have one or more bends or curves. As still another example, the diameter of the channel 234 can vary along its length.

The channel 224 in the body 219 of the example tubing spool 285 of FIGS. 2 and 3 is located toward the bottom end of the tubing spool 285. The channel 224 in this case includes two side ends 239. One side end 239-1 (defined by a wall 238-1 in the body 219) extends from one side of the cavity 243 (which also forms the top end of the annulus 223). Flow path 291-1 shows the path through the side end 239-1 of the channel 224 that a fluid can flow. In this case, the side end 239-1 of the channel 224 has a horizontal section adjacent to the cavity 243. At the distal end of this horizontal section is a vertical section that extends upward toward the top of the tubing spool 285. Along the length of this vertical section (in this case, about ⅓ up the length of the vertical section), another horizontal section extends to the outer perimeter of the tubing spool 285. The two horizontal sections and the vertical section can be substantially planar with respect to each other.

The other side end 239-2 (defined by a wall 238-2 in the body 219) extends from the opposite side of the cavity 243. In this case, the side end 239-2 is a single substantially horizontal section. The side end 239-2 of the channel 224 can be planar with the side end 239-1 of the channel 224. In some cases, the characteristics (e.g., cross-sectional shape, diameter) of the channel 224 (e.g., all of the side end 239-1 and all of the side end 239-2) can be substantially the same throughout the channel 224. In alternative embodiments, one or more characteristics of the channel 224 can vary along the length of the channel 224.

The channel 224 and the channel 234, including portions thereof, can have any of a number of configurations (e.g., cross-sectional shape, path, size) suitable to transport fluids therethrough. Part of the channel 234 runs in parallel with the channel 224 within the body 219 of the tubing spool 285, but at least part of the channel 234 may need to detour around one or more other portions (e.g., the top portion, one of the side ends 239) of the channel 224, or vice-versa. In some cases, the channel 224 and/or the channel 234 can be an aggregate of multiple channels that meet at the top, bottom, and/or side of the body 219 of the tubing spool 285.

In this example, valve 212-1 of the wellhead assembly 229 of FIG. 2 can be substantially the same as valve 112-1 of the wellhead assembly 129 of FIG. 1. Valve 212-2 of the wellhead assembly 229 of FIG. 2 can be substantially the same as valve 112-2 of the wellhead assembly 129 of FIG. 1. Valve 212-3 of the wellhead assembly 229 of FIG. 2 can be substantially the same as valve 112-3 of the wellhead assembly 129 of FIG. 1. Valve 212-4 of the wellhead assembly 229 of FIG. 2 can be substantially the same as valve 112-5 of the wellhead assembly 129 of FIG. 1. Valve 212-5 of the wellhead assembly 229 of FIG. 2 can be substantially the same as valve 112-6 of the wellhead assembly 129 of FIG. 1. Valve 212-6 of the wellhead assembly 229 of FIG. 2 can be substantially the same as valve 112-7 of the wellhead assembly 129 of FIG. 1. The wellhead assembly 229 of FIG. 2 does not include an equivalent of valve 112-4 of the wellhead assembly 129 of FIG. 1.

The side end 239-2 of the channel 224 is directly coupled to piping 288 and valve 212-1, which are in communication (through valve 212-2) with a steam injection system (e.g., steam injection system 130) and the injection portion (e.g., injection portion 108) of the wellhead assembly 229. In this case, the side end 239-2 of the channel 224 is configured to receive steam from the steam injection system. The side end 239-1 of the channel 224 is directly coupled to piping 288 and valve 212-4, which are in communication (along with valve 212-6) with a production system (e.g., production system 135) and the production portion (e.g., production portion 109) of the wellhead assembly 229. In this case, the side end 239-1 of the channel 224 is configured to direct a production fluid (e.g., production fluid 141) to the production system (e.g., production system 135).

Positioned within the side end 239-1 of the channel 224 is a bypass valve 236-1 (BPV 236-1). Specifically, the BPV 236-1 is positioned within the vertical section of the side end 239-1 of the channel 224, between the two horizontal sections of the side end 239-1. The BPV 236-1 can act as a check valve to isolate the channel 224. In alternative embodiments, there can be more than on BPV in the channel 224. Positioned above the BPV 236-1 in the vertical section of the side end 239-1 of the channel 224, above both horizontal sections of the side end 239-1, is a barrier 237-1. The barrier 237-1 (e.g., a crown plug) can be configured to isolate the channel 224 in terms of pressure, fluid flow or leakage, temperature, and/or any other suitable factor that can affect the operations within the annulus 223.

Positioned within the cavity 233 of the tubing hanger 289, below the channel 234, is a BPV 236-2 (substantially similar to the BPV 236-1 discussed above). In this case, the BPV 236-2 is vertically oriented within the cavity 233 of the tubing hanger 289. The BPV 236-1 can be configured the same as, or differently than, the BPV 236-2. Positioned above the BPV 236-2 in the cavity 233 of the tubing hanger 289 is a barrier 237-2, which can be substantially similar to the barrier 237-1 discussed above. The barrier 237-2 (e.g., a crown plug) can be configured to isolate the channel 234 in terms of pressure, fluid flow or leakage, temperature, and/or any other suitable factor that can affect the operations within the cavity 233 of the tubing hanger 289 and the tubing string 211.

Because of the configuration of channel 224 and channel 234 within the body 219 of the tubing spool 285 and their isolation from each other, channel 224 and channel 234 are each configured to facilitate flow of at least one fluid in either direction independently of each other. In this way, at a point in time, channel 224 can be isolated, configured for steam injection, or configured for fluid production, and simultaneously and independent of the configuration of channel 224, channel 234 can be isolated, configured for steam injection, or configured for fluid production.

Figure 4:
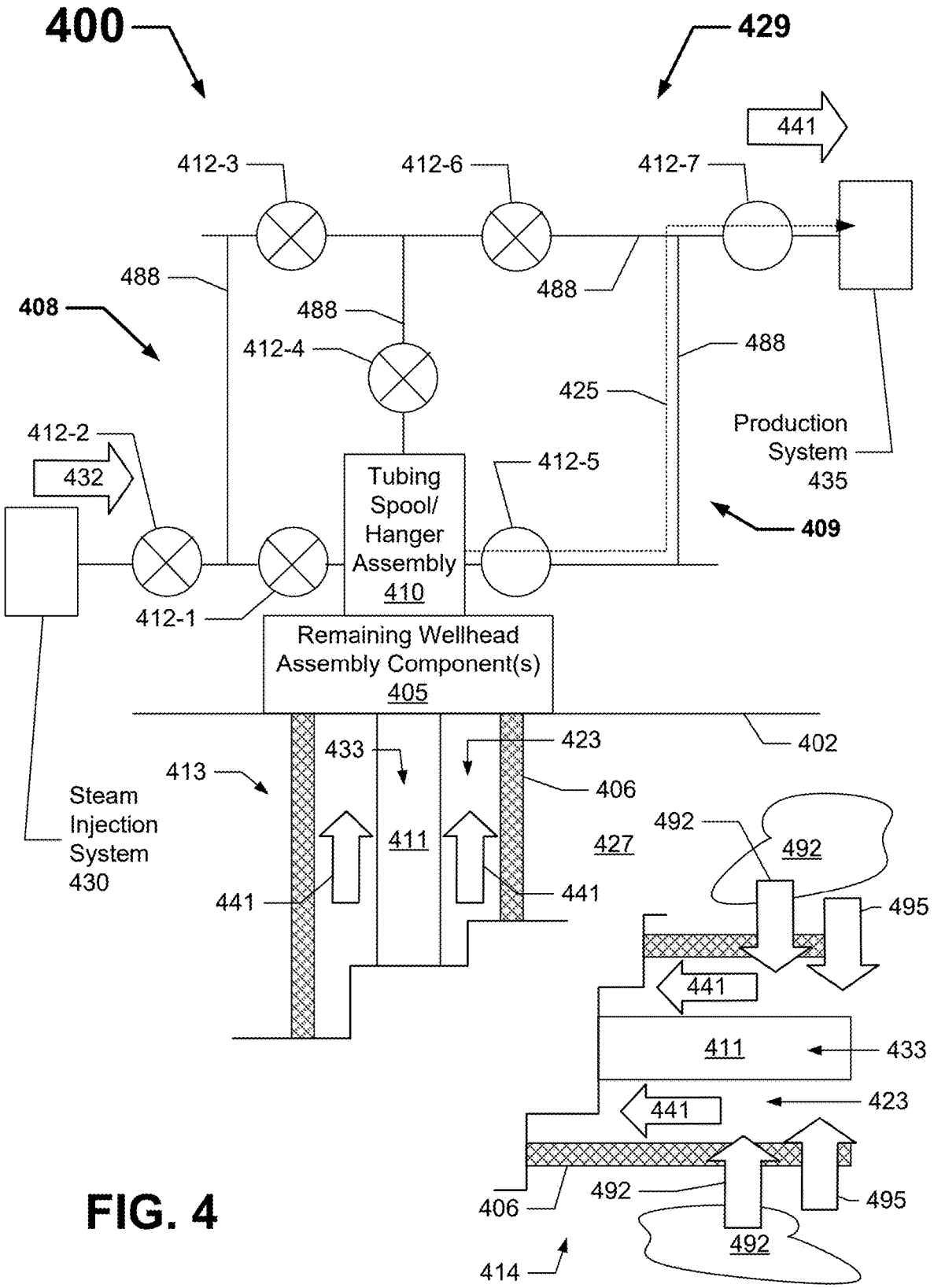
FIG. 4 shows a system that includes the wellhead assembly in an operational configuration for extracting a production fluid that includes a heavy oil according to certain example embodiments.
Figure 5:
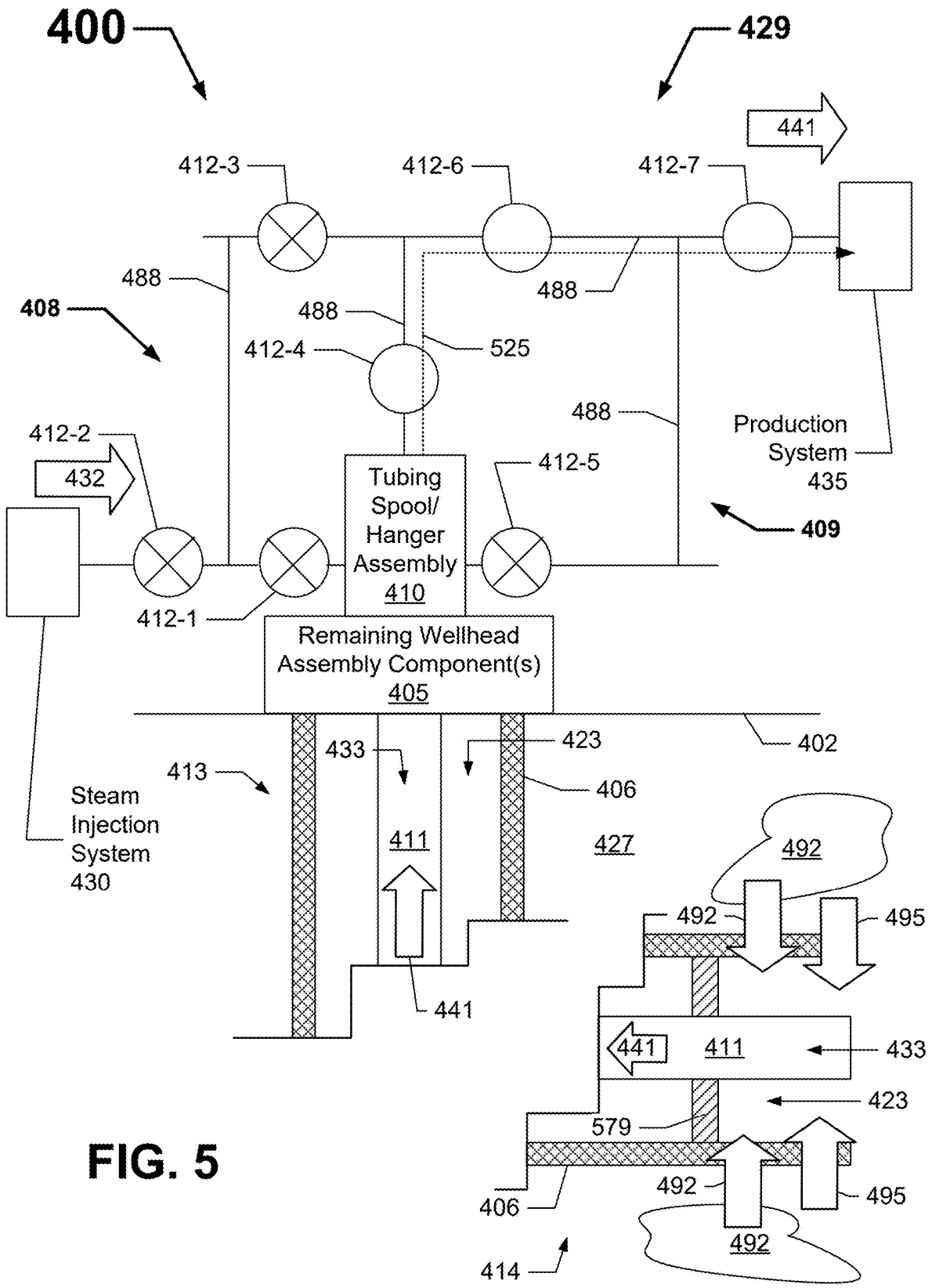
FIG. 5 shows the system of FIG. 4 where the wellhead assembly is in a different operational configuration relative to what is shown in FIG. 4 for extracting the production fluid that includes the heavy oil assembly according to certain example embodiments.
Figure 6:
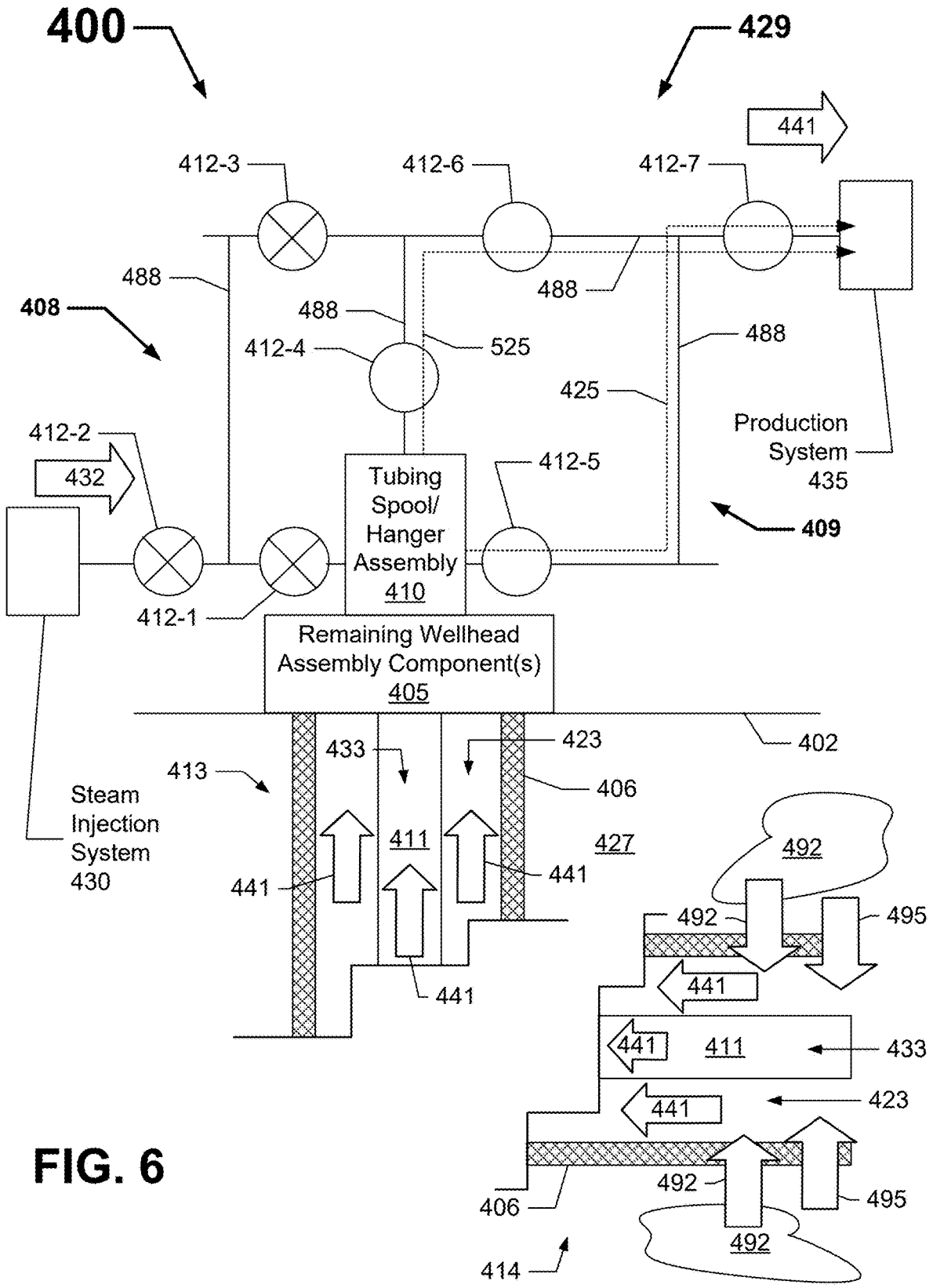
FIG. 6 shows the system of FIG. 4 where the wellhead assembly is in another different operational configuration relative to what is shown in FIGS. 4 and 5 for extracting the production fluid that includes the heavy oil according to certain example embodiments.

FIGS. 4 through 12 show examples in which a wellhead assembly 429 may be used in various field operations according to certain example embodiments. Specifically, FIG. 4 shows a system 400 that includes the wellhead assembly 429 in an operational configuration for extracting a production fluid 441 that includes a heavy oil 492 according to certain example embodiments. FIG. 5 shows the system 400 of FIG. 4 where the wellhead assembly 429 is in a different operational configuration relative to what is shown in FIG. 4 for extracting the production fluid 441 that includes the heavy oil 492 according to certain example embodiments. FIG. 6 shows the system 400 of FIG. 4 where the wellhead assembly 429 is in another different operational configuration relative to what is shown in FIGS. 4 and 5 for extracting the production fluid 441 that includes the heavy oil 492 according to certain example embodiments.

Figure 7:
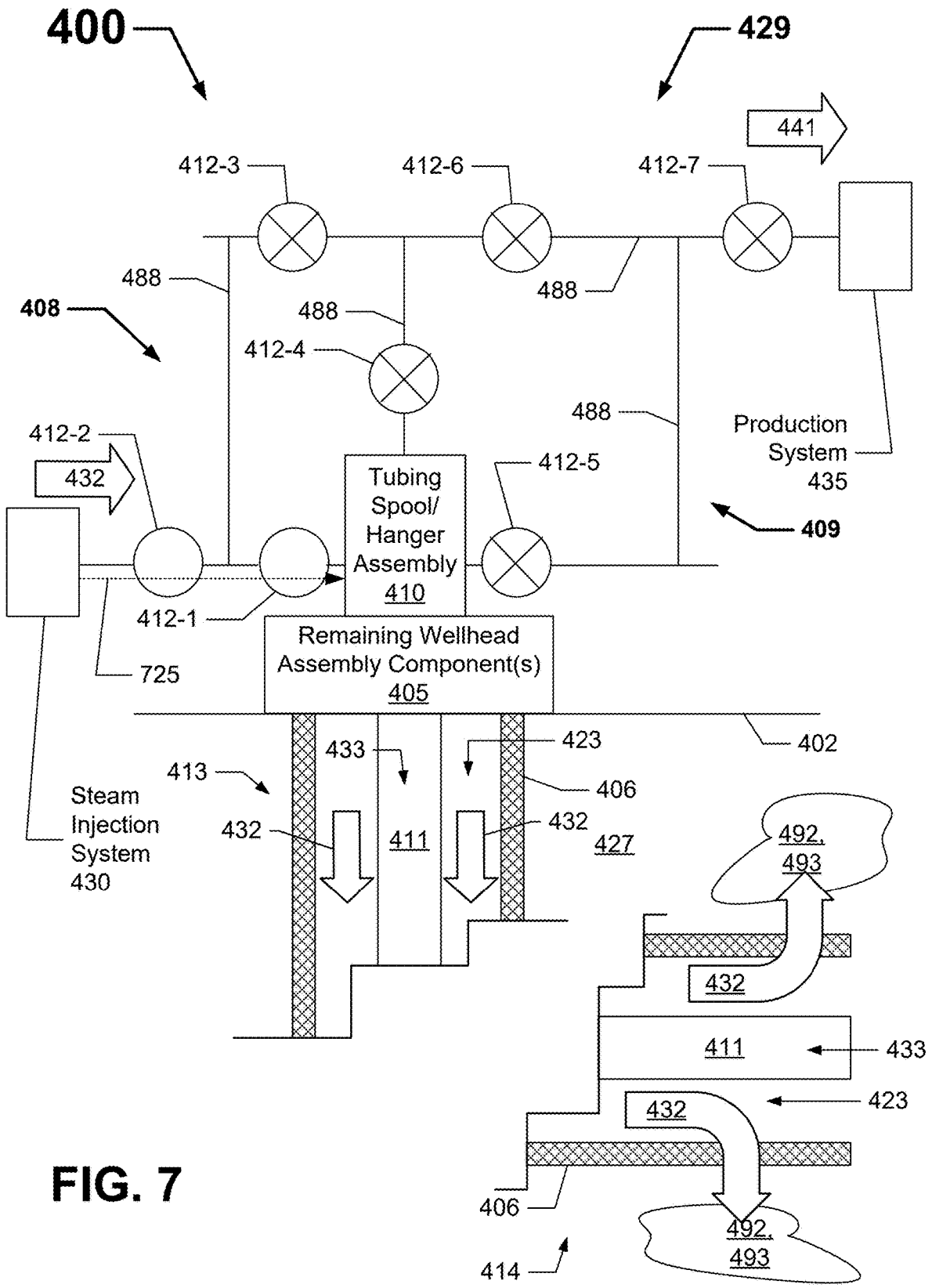
FIG. 7 shows the system 400 of FIG. 4 where the wellhead assembly is in an operational configuration for injecting steam according to certain example embodiments.
Figure 8:
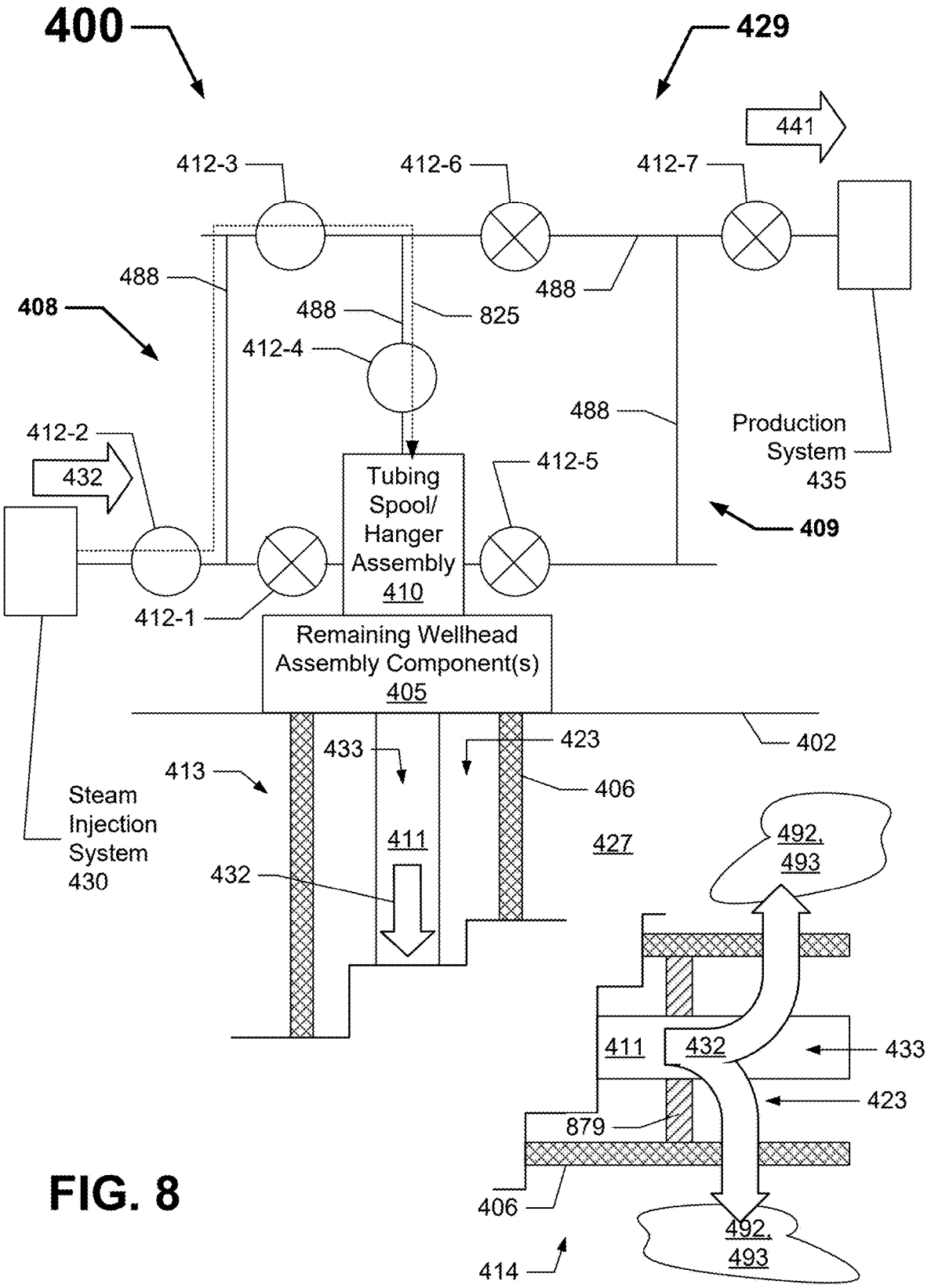
FIG. 8 shows the system of FIG. 4 where the wellhead assembly is in a different operational configuration relative to what is shown in FIG. 7 for injecting steam according to certain example embodiments.
Figure 9:
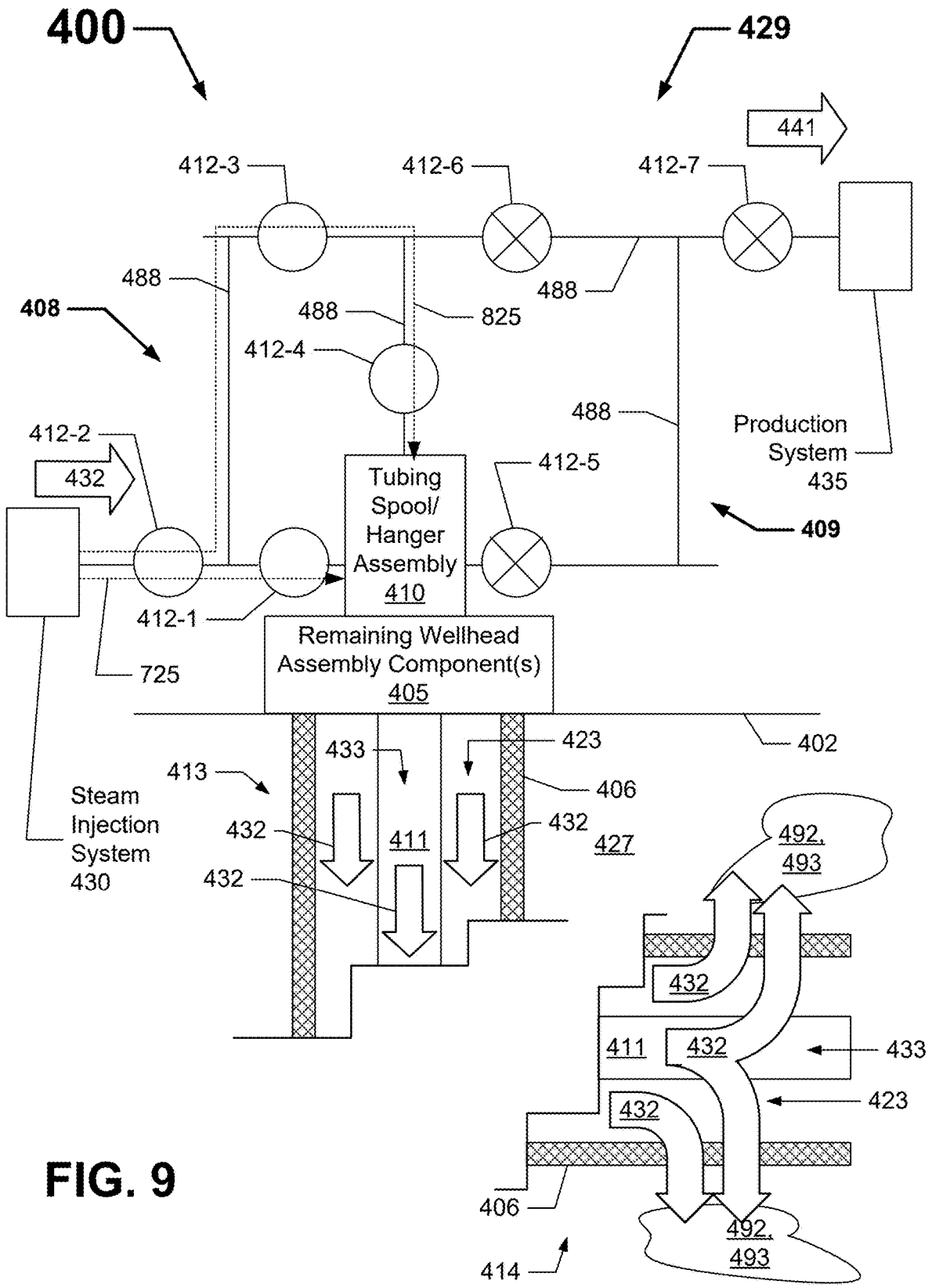
FIG. 9 shows the system of FIG. 4 where the wellhead assembly is in another different operational configuration relative to what is shown in FIGS. 7 and 8 for injecting steam according to certain example embodiments.

FIG. 7 shows the system 400 of FIG. 4 where the wellhead assembly 429 is in an operational configuration for injecting steam 432 according to certain example embodiments. FIG. 8 shows the system 400 of FIG. 4 where the wellhead assembly 429 is in a different operational configuration relative to what is shown in FIG. 7 for injecting steam 432 according to certain example embodiments. FIG. 9 shows the system 400 of FIG. 4 where the wellhead assembly 429 is in another different operational configuration relative to what is shown in FIGS. 7 and 8 for injecting steam 432 according to certain example embodiments.

Figure 10:
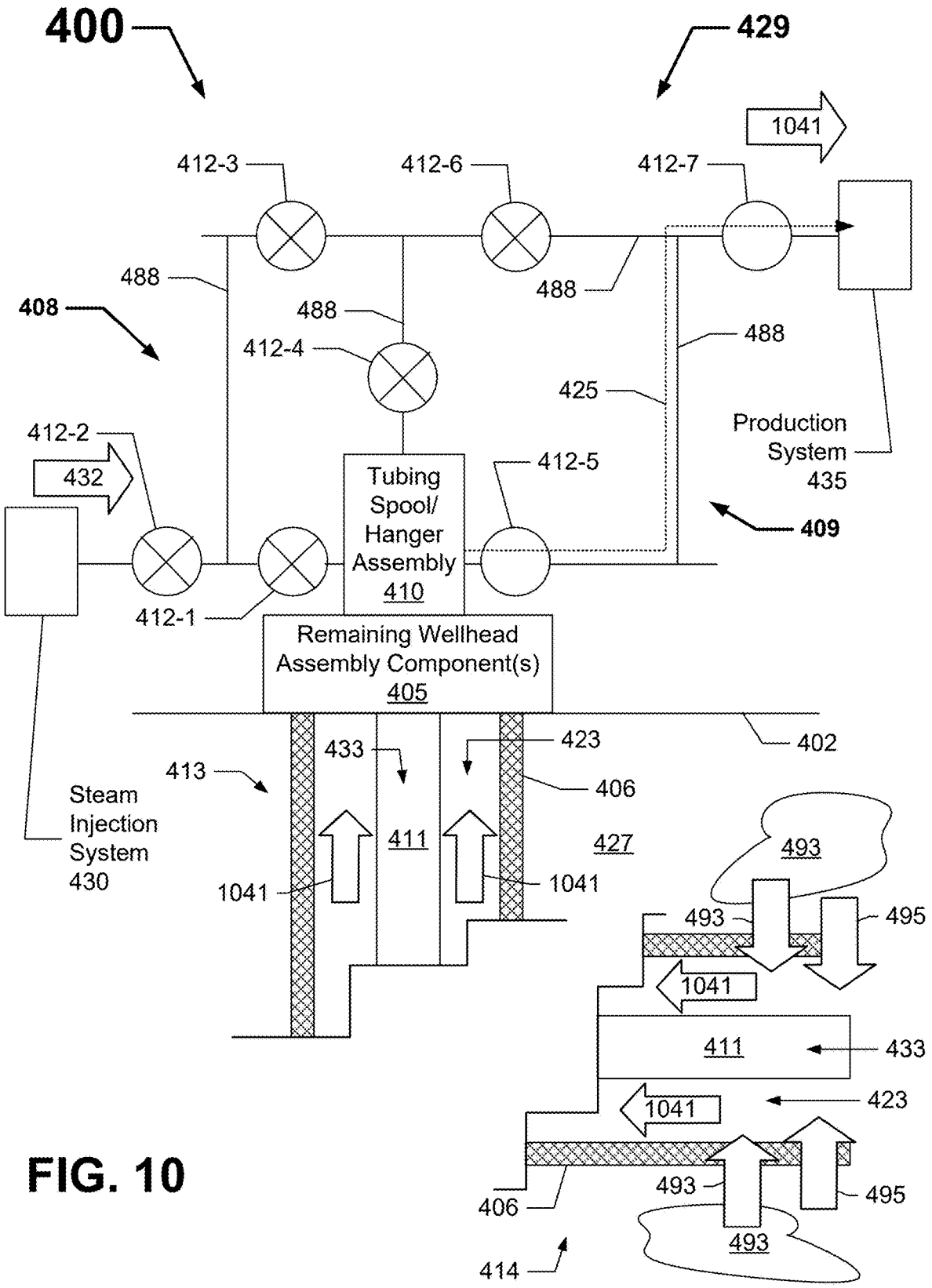
FIG. 10 shows the system of FIG. 4 where the wellhead assembly is in the operational configuration as shown in FIG. 4 for extracting a production fluid that includes a lower viscosity oil according to certain example embodiments.
Figure 11:
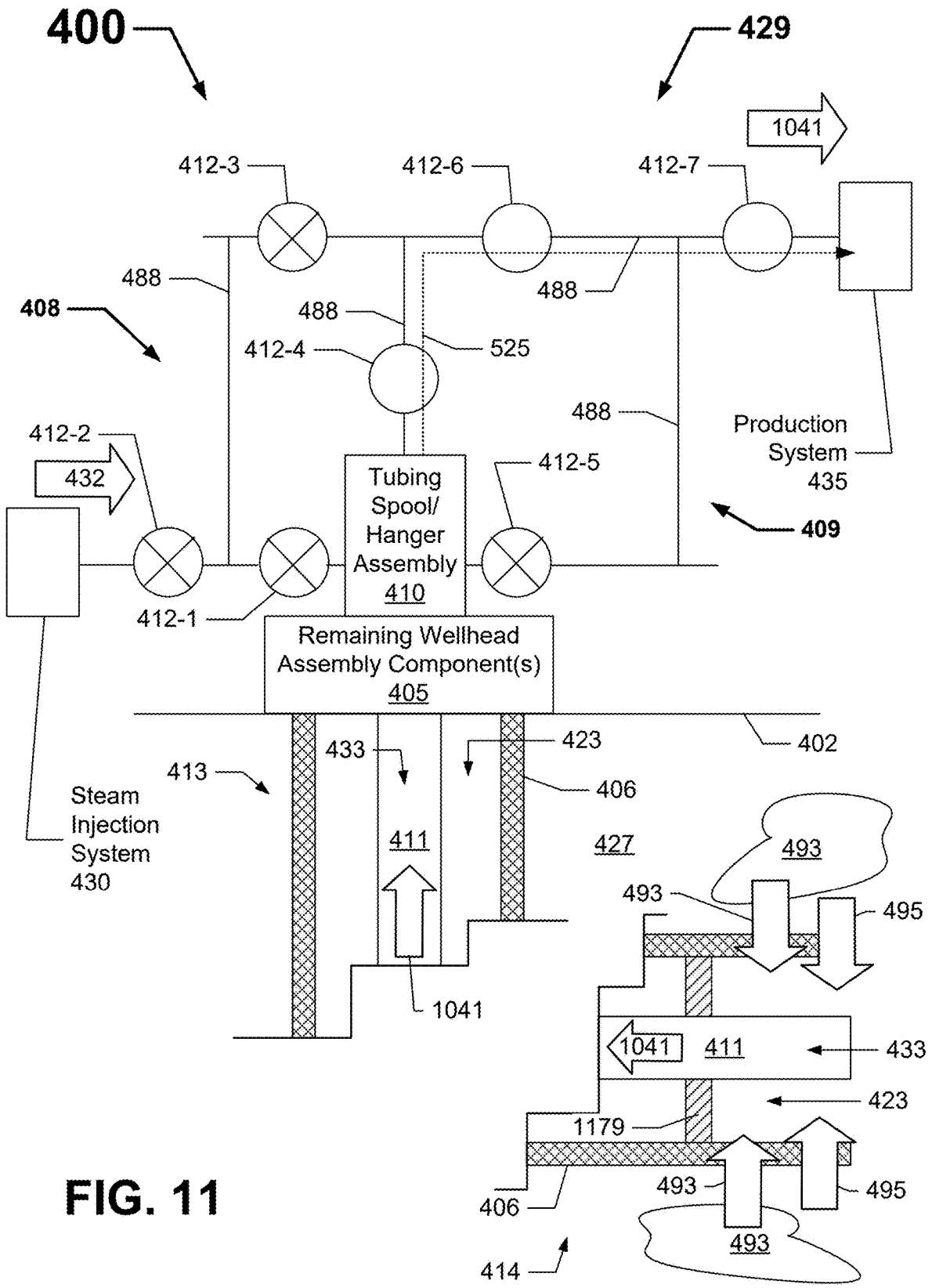
FIG. 11 shows the system of FIG. 4 where the wellhead assembly is in a different operational configuration relative to what is shown in FIG. 10 for extracting the production fluid that includes the lower viscosity oil according to certain example embodiments.
Figure 12:
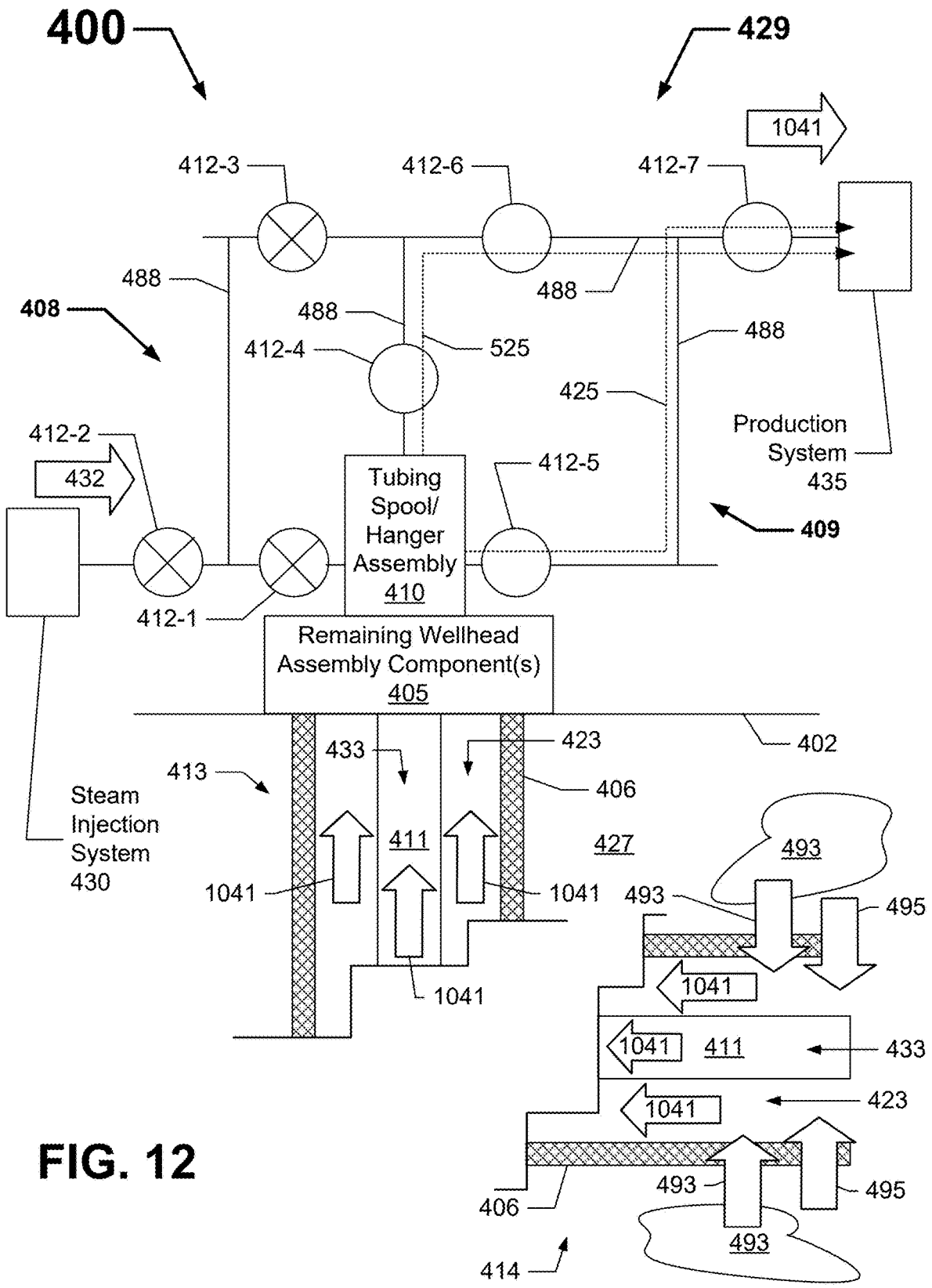
FIG. 12 shows the system of FIG. 4 where the wellhead assembly is in another different operational configuration relative to what is shown in FIGS. 10 and 11 for extracting the production fluid that includes the lower viscosity oil according to certain example embodiments.

FIG. 10 shows the system 400 of FIG. 4 where the wellhead assembly 429 is in the operational configuration as shown in FIG. 4 for extracting a production fluid 1041 that includes a lower viscosity oil 493 according to certain example embodiments. FIG. 11 shows the system 400 of FIG. 4 where the wellhead assembly 429 is in a different operational configuration relative to what is shown in FIG. 10 for extracting the production fluid 1041 that includes the lower viscosity oil 493 according to certain example embodiments. FIG. 12 shows the system 400 of FIG. 4 where the wellhead assembly 429 is in another different operational configuration relative to what is shown in FIGS. 10 and 11 for extracting the production fluid 1041 that includes the lower viscosity oil 493 according to certain example embodiments.

Referring to the description above with respect to FIGS. 1 through 3, the system 400 of FIGS. 4 through 12 includes the wellhead assembly 429, a steam injection system 430, a production system 435, a wellbore 413 drilled into the subterranean formation 427 below the surface 402, a production casing 406 at the outer perimeter of the wellbore 413, and a tubing string 411 disposed within the production casing 406. The tubing string 411 has a cavity 433 that runs along its length, and there is an annulus 423 between the tubing string 411 and the production casing 406. The wellhead assembly 429 includes seven valves 412 (valve 412-1, valve 412-2, valve 412-3, valve 412-4, valve 412-5, valve 412-6, and valve 412-7), a tubing spool/hanger assembly 410, one or more remaining wellhead assembly components 405, and piping 488.

All of these components of the system 400 of FIGS. 4 through 12 are substantially similar to the corresponding components of the system 100 discussed above with respect to FIG. 1. For example, the wellhead assembly 429 includes an injection portion 408 and a production portion 409. The injection portion 408 includes valve 412-1, valve 412-2, valve 412-3, valve 412-4, and the piping 488 that provides fluidic communication between these valves 412, the steam injection system 430, and the tubing spool/hanger assembly 410. The production portion 409 includes valve 412-4, valve 412-5, valve 412-6, valve 412-7, and the piping 488 that provides fluidic communication between these valves 412, the production system 435, and the tubing spool/hanger assembly 410. In this way, the valve 412-4 is part of the injection portion 408 and the production portion 409.

There are no sensor devices (substantially similar to the sensor devices 160 of FIG. 1) shown in FIGS. 4 through 12 to make the drawings easier to follow, but in the field the wellhead assembly 429 of the system 400 of FIGS. 4 through 12 can include one or more sensor devices. The valves 412 can sometimes be referred to as flow control valves 412 herein. In some cases, valve 412-4 can be omitted without adversely affecting the execution of the operational configurations shown in FIGS. 4 through 12. Also, any users (e.g., users 151), associated user systems (e.g., user systems 155), controllers (e.g., controllers 104), other sensor devices (e.g., other sensor devices 260), network manager (e.g., network manager 180), communication links (e.g., communication links 186), power transfer links (e.g., power transfer links 187) are not shown in the systems of FIGS. 4 through 12 to simplify the drawings.

FIGS. 4 through 6 capture a period of time (also sometimes called a time period herein) where example embodiments may be used to produce heavy oil 492 from the wellbore 413 using different configurations according to certain example embodiments. In the system 400 of FIG. 4, the wellhead assembly 429 is configured so that production fluid 441 that includes heavy oil 492 and formation fluids 495 (e.g., formation water) is extracted from the subterranean formation 427 through a lateral segment 414 of the wellbore 413. Such is the case when conditions are sufficient to produce the heavy oil 492 without lowering the viscosity of the heavy oil 492. In this case, the cavity 433 of the tubing string 411 is isolated and the annulus 423 is produced with production fluid 441 (also called producing the annulus 423 at times herein). To accomplish this operational configuration, valve 412-1 is fully closed, valve 412-2 is fully open (although in alternative embodiments may be fully closed), valve 412-3 is fully closed, valve 412-4 is fully closed, valve 412-5 is fully open, valve 412-6 is fully closed, and valve 412-7 is fully open. This configuration of the wellhead assembly 429 creates a flow path 425 for the production fluid 441 through the production portion 409.

As a result of the above configurations of the valves 412 of the wellhead assembly 429 of the system 400 of FIG. 4, the steam injection system 430 and the injection portion 408 of the wellhead assembly 429 are closed off so that steam 432 is not injected into the wellbore 413. Also, as a result of the configurations of the valves 412 of the wellhead assembly 429, the cavity 433 of the tubing string 411 is isolated (not producing production fluid 441 and not receiving steam 432). At the same time, the production system 435 and the production portion 409 of the wellhead assembly 429 produces production fluids 441 from the wellbore 413 through the annulus 423, through a channel (similar to channel 224 of FIGS. 2 and 3) and a side end (similar to side end 239-1 of FIGS. 2 and 3) of the tubing spool/hanger assembly 410, through valve 412-5 and valve 412-7 (including associated piping 488) of the production portion 409 of the wellhead assembly 429 to the production system 435.

The subterranean formation 427 adjacent to the distal end of the wellbore 413 of the system 400 of FIG. 4 includes pockets (and/or other forms of quantity) of heavy oil 492 as well as formation fluids 495 (e.g., formation water). In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. A mixture of the heavy oil 492 and the formation fluids 495 results in the production fluid 441, which enters the annulus 423 and is produced therefrom.

In the system 400 of FIG. 5, the wellhead assembly 429 is configured so that production fluid 441 that includes heavy oil 492 and formation fluids 495 is extracted from the subterranean formation 427 through the lateral segment 414 of the wellbore 413. Such is the case when conditions are sufficient to produce the heavy oil 492 without lowering the viscosity of the heavy oil 492. In this case, the annulus 423 is isolated and the cavity 433 of the tubing string 411 is produced with production fluid 441 (also called producing the cavity 433 of the tubing string 411 at times herein). To accomplish this operational configuration, valve 412-1 is fully closed, valve 412-2 is fully closed (although in alternative embodiments may be fully open), valve 412-3 is fully closed, valve 412-4 is fully open, valve 412-5 is fully closed, valve 412-6 is fully open, and valve 412-7 is fully open. This configuration of the wellhead assembly 429 creates a flow path 525 for the production fluid 441 through the production portion 409.

As a result of the above configurations of the valves 412 of the wellhead assembly 429 of the system 400 of FIG. 5, the steam injection system 430 and the injection portion 408 of the wellhead assembly 429 are closed off so that steam 432 is not injected into the wellbore 413. Also, as a result of the configurations of the valves 412 of the wellhead assembly 429, the annulus 423 is isolated (not producing production fluid 441 and not receiving steam 432). At the same time, the production system 435 produces production fluids 441 from the wellbore 413 through the cavity 433 of the tubing string 411, through a channel (similar to channel 234 of FIGS. 2 and 3) and a top end of the tubing spool/hanger assembly 410, through valve 412-4, valve 412-6, and valve 412-7 (including associated piping 488) of the production portion 409 of the wellhead assembly 429 to the production system 435.

The subterranean formation 427 adjacent to the distal end of the wellbore 413 of the system 400 of FIG. 5 includes pockets (and/or other forms of quantity) of heavy oil 492 as well as formation fluids 495 (e.g., formation water). In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. A mixture of the heavy oil 492 and the formation fluids 495 results in the production fluid 441, which enters the cavity 433 of the tubing string 411 and is produced therefrom. One or more packers 579 may be installed within the annulus 423 to prevent production of the heavy oil 492 through the annulus 423 and focus production of the heavy oil 492 through the cavity 433 of the tubing string 411.

In the system 400 of FIG. 6, the wellhead assembly 429 is configured so that production fluid 441 that includes heavy oil 492 and formation fluids 495 is extracted from the subterranean formation 427 through the lateral segment 414 of the wellbore 413. Such is the case when conditions are sufficient to produce the heavy oil 492 without lowering the viscosity of the heavy oil 492. In this case, the cavity 433 of the tubing string 411 and the annulus 423 simultaneously produce the production fluid 441. To accomplish this operational configuration, valve 412-1 is fully closed, valve 412-2 is fully closed (although in alternative embodiments may be fully open), valve 412-3 is fully closed, valve 412-4 is fully open, valve 412-5 is fully open, valve 412-6 is fully open, and valve 412-7 is fully open. This configuration of the wellhead assembly 429 creates two flow paths (flow path 425 and flow path 525) for the production fluid 441 through the production portion 409.

As a result of the above configurations of the valves 412 of the wellhead assembly 429 of the system 400 of FIG. 6, the steam injection system 430 and the injection portion 408 of the wellhead assembly 429 are closed off so that steam 432 is not injected into the wellbore 413. Also, as a result of the configurations of the valves 412 of the wellhead assembly 429, the production system 435 produces production fluids 441 from the wellbore 413 in parallel a) through the annulus 423 and the cavity 433 of the tubing string 411, through a channel (similar to channel 234 of FIGS. 2 and 3) and a side end (similar to side end 239-1 of FIGS. 2 and 3) of the tubing spool/hanger assembly 410, through valve 412-5 and valve 412-7 (including associated piping 488) of the production portion 409 of the wellhead assembly 429 to the production system 435, and b) through the cavity 433 of the tubing string 411, through a channel (similar to channel 234 of FIGS. 2 and 3) and a top end of the tubing spool/hanger assembly 410, through valve 412-4, valve 412-6, and valve 412-7 (including associated piping 488) of the production portion 409 of the wellhead assembly 429 to the production system 435.

The subterranean formation 427 adjacent to the distal end of the wellbore 413 of the system 400 of FIG. 6 includes pockets (and/or other forms of quantity) of heavy oil 492 as well as formation fluids 495 (e.g., formation water). In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. A mixture of the heavy oil 492 and the formation fluids 495 results in the production fluid 441, which simultaneously enters the annulus 423 and the cavity 433 of the tubing string 411 and is simultaneously produced therefrom.

FIGS. 7 through 9 capture a period of time, subsequent to the period of time captured in FIGS. 4 through 6, where example embodiments may be used to inject steam 432 to reduce the viscosity of heavy oil 492 within the subterranean formation 427 using different configurations according to certain example embodiments. In the system 400 of FIG. 7, the wellhead assembly 429 is configured so that steam 432 is injected into the subterranean formation 427 through the lateral segment 414 of the wellbore 413. Such is the case when conditions are insufficient to produce the heavy oil 492 without lowering the viscosity of the heavy oil 492. In this case, the cavity 433 of the tubing string 411 is isolated and the annulus 423 is injected with steam 432. To accomplish this operational configuration, valve 412-1 is fully open, valve 412-2 is fully open, valve 412-3 is fully closed, valve 412-4 is fully closed, valve 412-5 is fully closed, valve 412-6 is fully closed, and valve 412-7 is fully closed. This configuration of the wellhead assembly 429 creates a flow path 725 for the steam 432 through the injection portion 408.

As a result of the above configurations of the valves 412 of the wellhead assembly 429 of the system 400 of FIG. 7, the production system 435 and the production portion 409 of the wellhead assembly 429 are closed off so that production fluid 441 is not produced from the wellbore 413. Also, as a result of the configurations of the valves 412 of the wellhead assembly 429, the cavity 433 of the tubing string 411 is isolated (not producing production fluid 441 and not receiving steam 432). At the same time, the steam injection system 430 injects steam 432 through valve 412-2 and valve 412-1 (including associated piping 488) of the injection portion 408 of the wellhead assembly 429, through a side end (similar to side end 239-2 of FIGS. 2 and 3) and a channel (similar to channel 224 of FIGS. 2 and 3) and of the tubing spool/hanger assembly 410, and into the wellbore 413 through the annulus 423.

The subterranean formation 427 adjacent to the distal end of the wellbore 413 of the system 400 of FIG. 7 includes pockets (and/or other forms of quantity) of heavy oil 492. In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. The steam 432 that is injected through the annulus 423 enters the subterranean formation 427 toward the end of the wellbore 413 and mixes with the heavy oil 492 to form oil 493 with relatively lower viscosity compared to the viscosity of the heavy oil 492.

In the system 400 of FIG. 8, the wellhead assembly 429 is configured so that steam 432 is injected into the subterranean formation 427 through the lateral segment 414 of the wellbore 413. Such is the case when conditions are insufficient to produce the heavy oil 492 without lowering the viscosity of the heavy oil 492. In this case, the annulus 423 is isolated and the cavity 433 of the tubing string 411 is injected with steam 432. To accomplish this operational configuration, valve 412-1 is fully closed, valve 412-2 is fully open, valve 412-3 is fully open, valve 412-4 is fully open, valve 412-5 is fully closed, valve 412-6 is fully closed, and valve 412-7 is fully closed. This configuration of the wellhead assembly 429 creates a flow path 825 for the steam 432 through the injection portion 408.

As a result of the above configurations of the valves 412 of the wellhead assembly 429 of the system 400 of FIG. 8, the production system 435 and the production portion 409 of the wellhead assembly 429 are closed off so that production fluid 441 is not produced from the wellbore 413. Also, as a result of the configurations of the valves 412 of the wellhead assembly 429, the annulus 423 is isolated (not producing production fluid 441 and not receiving steam 432). At the same time, the steam injection system 430 injects steam 432 through valve 412-2, valve 412-3, and valve 412-4 (including associated piping 488) of the injection portion 408 of the wellhead assembly 429, through a channel (similar to channel 234 of FIGS. 2 and 3) of the tubing spool/hanger assembly 410, and into the wellbore 413 through the cavity 433 of the tubing string 411.

The subterranean formation 427 adjacent to the distal end of the wellbore 413 of the system 400 of FIG. 8 includes pockets (and/or other forms of quantity) of heavy oil 492. In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. The steam 432 that is injected through the cavity 433 of the tubing string 411 enters the subterranean formation 427 toward the end of the wellbore 413 and mixes with the heavy oil 492 to form oil 493 with relatively lower viscosity compared to the viscosity of the heavy oil 492. One or more packers 879 may be installed within the annulus 423 to prevent injection of the steam 432 from propagating through the annulus 423 and focus injection of the steam 432 into the subterranean formation 427.

In the system 400 of FIG. 9, the wellhead assembly 429 is configured so that steam 432 is injected into the subterranean formation 427 through the lateral segment 414 of the wellbore 413. Such is the case when conditions are insufficient to produce the heavy oil 492 without lowering the viscosity of the heavy oil 492. In this case, the cavity 433 of the tubing string 411 and the annulus 423 are simultaneously injected with steam 432. To accomplish this operational configuration, valve 412-1 is fully open, valve 412-2 is fully open, valve 412-3 is fully open, valve 412-4 is fully open, valve 412-5 is fully closed, valve 412-6 is fully closed, and valve 412-7 is fully closed. This configuration of the wellhead assembly 429 creates two flow paths (flow path 725 and flow path 825) for the steam 432 through the injection portion 408.

As a result of the above configurations of the valves 412 of the wellhead assembly 429 of the system 400 of FIG. 9, the production system 435 and the production portion 409 of the wellhead assembly 429 are closed off so that production fluid 441 is not produced from the wellbore 413. Also, as a result of the configurations of the valves 412 of the wellhead assembly 429, the steam injection system 430 injects steam 432 in parallel a) through valve 412-2 and valve 412-1 (including associated piping 488) of the injection portion 408 of the wellhead assembly 429, through a side end (similar to side end 239-2 of FIGS. 2 and 3) and a channel (similar to channel 224 of FIGS. 2 and 3) and of the tubing spool/hanger assembly 410, and into the wellbore 413 through the annulus 423, and b) through valve 412-2, valve 412-3, and valve 412-4 (including associated piping 488) of the injection portion 408 of the wellhead assembly 429, through a channel (similar to channel 234 of FIGS. 2 and 3) of the tubing spool/hanger assembly 410, and into the wellbore 413 through the cavity 433 of the tubing string 411.

The subterranean formation 427 adjacent to the distal end of the wellbore 413 of the system 400 of FIG. 9 includes pockets (and/or other forms of quantity) of heavy oil 492. In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. The steam 432 that is simultaneously injected through the annulus 423 and the cavity 433 of the tubing string 411 simultaneously enters the subterranean formation 427 toward the end of the wellbore 413 and mixes with the heavy oil 492 to form oil 493 with relatively lower viscosity compared to the viscosity of the heavy oil 492.

FIGS. 10 through 12 capture a period of time, subsequent to the period of time captured in FIGS. 7 through 9, where example embodiments may be used to produce oil 493 (the result of injected steam 432 reducing the viscosity of heavy oil 492) from the wellbore 413 using different configurations according to certain example embodiments. In some cases, there is a gap in time between the period of time in which injection of the steam 432 occurs and the subsequent period of time in which production of the oil 493 (having lower viscosity compared to the viscosity of the heavy oil 492) occurs. In such cases, the steam 432 is given sufficient time to saturate a volume of space within the subterranean formation within the subterranean formation 427 through the wellbore 413, thereby allowing a significant amount of the heavy oil 492 to be converted to the oil 493 of lower viscosity.

In the system 400 of FIG. 10, the wellhead assembly 429 is configured so that production fluid 1041 that includes the oil 493 of lower viscosity (compared to the viscosity of the heavy oil 492 of FIGS. 4 through 9) and formation fluids 495 is extracted from the subterranean formation 427 through the lateral segment 414 of the wellbore 413. In this case, the cavity 433 of the tubing string 411 is isolated and the annulus 423 is produced with production fluid 1041. To accomplish this operational configuration, valve 412-1 is fully closed, valve 412-2 is fully open (although in alternative embodiments may be fully closed), valve 412-3 is fully closed, valve 412-4 is fully closed, valve 412-5 is fully open, valve 412-6 is fully closed, and valve 412-7 is fully open. This configuration of the wellhead assembly 429 creates the flow path 425 for the production fluid 1041 through the production portion 409.

As a result of the above configurations of the valves 412 of the wellhead assembly 429 of the system 400 of FIG. 10, the steam injection system 430 and the injection portion 408 of the wellhead assembly 429 are closed off so that steam 432 is not injected into the wellbore 413. Also, as a result of the configurations of the valves 412 of the wellhead assembly 429, the cavity 433 of the tubing string 411 is isolated (not producing production fluid 1041 and not receiving steam 432). At the same time, the production system 435 and the production portion 409 of the wellhead assembly 429 produces production fluids 1041 from the wellbore 413 through the annulus 423, through a channel (similar to channel 224 of FIGS. 2 and 3) and a side end (similar to side end 239-1 of FIGS. 2 and 3) of the tubing spool/hanger assembly 410, through valve 412-5 and valve 412-7 (including associated piping 488) of the production portion 409 of the wellhead assembly 429 to the production system 435.

The subterranean formation 427 adjacent to the distal end of the wellbore 413 of the system 400 of FIG. 10 includes pockets (and/or other forms of quantity) of oil 493 as well as formation fluids 495 (e.g., formation water). In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. A mixture of the oil 493 and the formation fluids 495 results in the production fluid 1041, which enters the annulus 423 and is produced therefrom.

In the system 400 of FIG. 11, the wellhead assembly 429 is configured so that production fluid 1041 that includes the oil 493 of lower viscosity (compared to the viscosity of the heavy oil 492 of FIGS. 4 through 9) and formation fluids 495 is extracted from the subterranean formation 427 through the lateral segment 414 of the wellbore 413. In this case, the annulus 423 is isolated and the cavity 433 of the tubing string 411 is produced with production fluid 1041. To accomplish this operational configuration, valve 412-1 is fully closed, valve 412-2 is fully closed (although in alternative embodiments may be fully open), valve 412-3 is fully closed, valve 412-4 is fully open, valve 412-5 is fully closed, valve 412-6 is fully open, and valve 412-7 is fully open. This configuration of the wellhead assembly 429 creates the flow path 525 for the production fluid 1041 through the production portion 409, As a result of the above configurations of the valves 412 of the wellhead assembly 429 of the system 400 of FIG. 11, the steam injection system 430 and the injection portion 408 of the wellhead assembly 429 are closed off so that steam 432 is not injected into the wellbore 413. Also, as a result of the configurations of the valves 412 of the wellhead assembly 429, the annulus 423 is isolated (not producing production fluid 1041 and not receiving steam 432). At the same time, the production system 435 produces production fluids 1041 from the wellbore 413 through the cavity 433 of the tubing string 411, through a channel (similar to channel 234 of FIGS. 2 and 3) and a top end of the tubing spool/hanger assembly 410, through valve 412-4, valve 412-6, and valve 412-7 (including associated piping 488) of the production portion 409 of the wellhead assembly 429 to the production system 435.

The subterranean formation 427 adjacent to the distal end of the wellbore 413 of the system 400 of FIG. 11 includes pockets (and/or other forms of quantity) of oil 493 as well as formation fluids 495 (e.g., formation water). In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. A mixture of the oil 493 and the formation fluids 495 results in the production fluid 1041, which enters the cavity 433 of the tubing string 411 and is produced therefrom. One or more packers 1179 may be installed within the annulus 423 to prevent production of the production fluid 1041 through the annulus 423 and focus production of the production fluid 1041 through the cavity 433 of the tubing string 411.

In the system 400 of FIG. 12, the wellhead assembly 429 is configured so that production fluid 1041 that includes oil 493 with lower viscosity (compared to the viscosity of the heavy oil 492 of FIGS. 4 through 9) and formation fluids 495 is extracted from the subterranean formation 427 through the lateral segment 414 of the wellbore 413. In this case, the cavity 433 of the tubing string 411 and the annulus 423 simultaneously produce the production fluid 1041. To accomplish this operational configuration, valve 412-1 is fully closed, valve 412-2 is fully closed (although in alternative embodiments may be fully open), valve 412-3 is fully closed, valve 412-4 is fully open, valve 412-5 is fully open, valve 412-6 is fully open, and valve 412-7 is fully open. This configuration of the wellhead assembly 429 creates two flow paths (flow path 425 and flow path 525) for the production fluid 1041 through the production portion 409.

As a result of the above configurations of the valves 412 of the wellhead assembly 429 of the system 400 of FIG. 12, the steam injection system 430 and the injection portion 408 of the wellhead assembly 429 are closed off so that steam 432 is not injected into the wellbore 413. Also, as a result of the configurations of the valves 412 of the wellhead assembly 429, the production system 435 produces production fluids 1041 from the wellbore 413 in parallel a) through the annulus 423 and the cavity 433 of the tubing string 411, through a channel (similar to channel 234 of FIGS. 2 and 3) and a side end (similar to side end 239-1 of FIGS. 2 and 3) of the tubing spool/hanger assembly 410, through valve 412-5 and valve 412-7 (including associated piping 488) of the production portion 409 of the wellhead assembly 429 to the production system 435, and b) through the cavity 433 of the tubing string 411, through a channel (similar to channel 234 of FIGS. 2 and 3) and a top end of the tubing spool/hanger assembly 410, through valve 412-4, valve 412-6, and valve 412-7 (including associated piping 488) of the production portion 409 of the wellhead assembly 429 to the production system 435.

The subterranean formation 427 adjacent to the distal end of the wellbore 413 of the system 400 of FIG. 12 includes pockets (and/or other forms of quantity) of oil 493 as well as formation fluids 495 (e.g., formation water). In this case, the distal end of the wellbore 413 is shown to be substantially horizontal. In alternative embodiments, the distal end of the wellbore 413 may have any of a number of other orientations (e.g., substantially vertical, transitional, curved) within the subterranean formation 427. A mixture of the oil 493 and the formation fluids 495 results in the production fluid 1041, which simultaneously enters the annulus 423 and the cavity 433 of the tubing string 411 and is simultaneously produced therefrom.

In some cases, after a time period of injection of steam 432 (as set forth, by way of example, in FIGS. 7 through 9 above) into the subterranean formation 427 has been executed, followed by a subsequent time period of production of produced fluids 441 (as set forth, by way of example, in FIGS. 10 through 12 above and including oil 493), the process may be repeated in another cycle in the event that more heavy oil 492 in the subterranean formation 427 may be converted into oil 493 for additional production with the injection of additional steam 432.

Figure 13A:
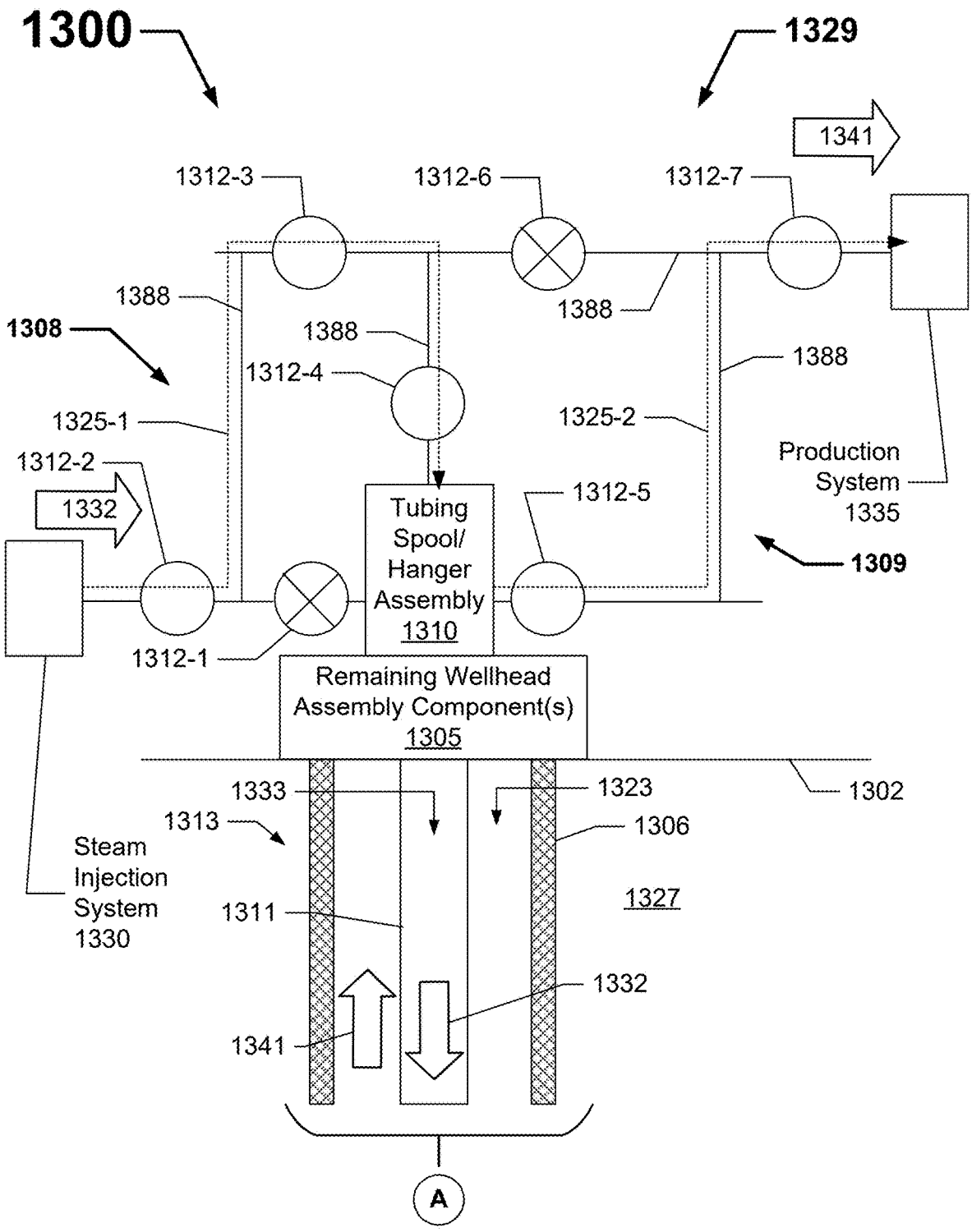
FIGS. 13A and 13B show a system that includes an example wellhead assembly used to perform simultaneous field operations on a wellbore with multiple lateral segments according to certain example embodiments.
Figure 13B:
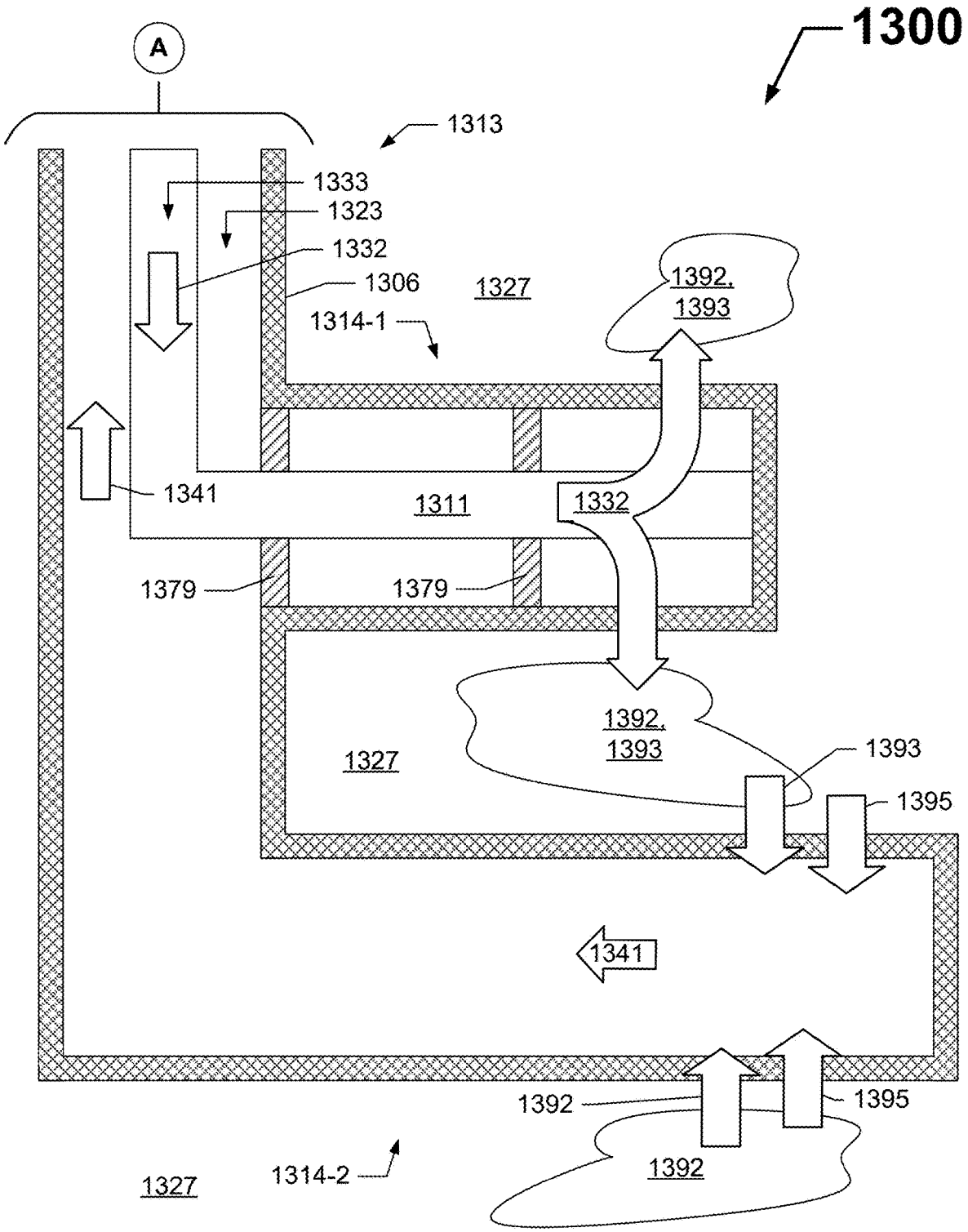

FIGS. 13A and 13B show a system 1300 that includes an example wellhead assembly 1329 used to perform simultaneous field operations on a wellbore 1313 with multiple lateral segments 1314 according to certain example embodiments. Referring to the description above with respect to FIGS. 1 through 12, the system 1300 of FIGS. 13A and 13B includes the wellhead assembly 1329, a steam injection system 1330, a production system 1335, a wellbore 1313 drilled into a subterranean formation 1327 below the surface 1302, a production casing 1306 at the outer perimeter of the wellbore 1313, and a tubing string 1311 disposed within the production casing 1306. The tubing string 1311 has a cavity 1333 that runs along its length, and there is an annulus 1323 between the tubing string 1311 and the production casing 1306. The wellhead assembly 1329 includes seven valves 1312 (valve 1312-1, valve 1312-2, valve 1312-3, valve 1312-4, valve 1312-5, valve 1312-6, and valve 1312-7), a tubing spool/hanger assembly 1310, one or more remaining wellhead assembly components 1305, and piping 1388.

All of these components of the system 1300 of FIGS. 13A and 13B are substantially similar to the corresponding components of the system 100 discussed above with respect to FIG. 1 and the system 400 discussed above with respect to FIGS. 4 through 12. For example, the wellhead assembly 1329 includes an injection portion 1308 and a production portion 1309. The injection portion 1308 includes valve 1312-1, valve 1312-2, valve 1312-3, valve 1312-4, and the piping 1388 that provides fluidic communication between these valves 1312, the steam injection system 1330, and the tubing spool/hanger assembly 1310. The production portion 1309 includes valve 1312-4, valve 1312-5, valve 1312-6, valve 1312-7, and the piping 1388 that provides fluidic communication between these valves 1312, the production system 1335, and the tubing spool/hanger assembly 1310. In this way, the valve 1312-4 is part of the injection portion 1308 and the production portion 1309.

There are no sensor devices (substantially similar to the sensor devices 160 of FIG. 1) shown in FIGS. 13A and 13B to make the drawings easier to follow, but in the field the wellhead assembly 1329 of the system 1300 of FIGS. 13A and 13B can include one or more sensor devices. The valves 1312 can sometimes be referred to as flow control valves 1312 herein. In some cases, valve 1312-4 can be omitted without adversely affecting the execution of the operational configurations shown in FIGS. 13A and 13B. Also, any users (e.g., users 151), associated user systems (e.g., user systems 155), controllers (e.g., controllers 104), other sensor devices (e.g., other sensor devices 260), network manager (e.g., network manager 180), communication links (e.g., communication links 186), power transfer links (e.g., power transfer links 187) are not shown in the systems of FIGS. 13A and 13B to simplify the drawings.

As discussed above, the wellbore 1313 of FIGS. 13A and 13B has two lateral segments 1314 (lateral segment 1314-1 and lateral segment 1314-2). While each lateral segment 1314 in this case is a substantially horizontal segment, and the two lateral segments 1314 are substantially parallel to each other. In alternative embodiments, one or both lateral segments 1314 may be non-horizontal. In addition, or in the alternative, lateral segment 1314-1 and lateral segment 1314-2 may be antiparallel with respect to each other. In any case, there is some amount of fluidic communication between lateral segment 1314-1 and lateral segment 1314-2 through fractures in the subterranean formation 1327.

In this case, the tubing string 1311 is inserted into the lateral segment 1314-1, and the annulus 1323 within the lateral segment 1314-1 is isolated from the rest of the annulus 1323 (i.e., within the vertical section of the wellbore 1313) by one or more (in this case, two) packers 1379. One or more packers 1379 may also be used to isolate or restrict the injection zone within the lateral segment 1314-1 (the portion(s) of the lateral segment 1314-1 where steam 1332 is injected into the subterranean wellbore 1313).

At the time captured in FIGS. 13A and 13B, the wellhead assembly 1329 of the system 1300 is configured so that injection of steam 1332 and production of production fluids 1341 occur simultaneously. Specifically, steam 1332 is injected down the cavity 1333 of the tubing string 1311 at the same time that production fluids 1341 are produced up the annulus 1323. For this to occur, valve 1312-1 is fully closed, valve 1312-2 is fully open, valve 1312-3 is fully open, valve 1312-4 is fully open, valve 1312-5 is fully open, valve 1312-6 is fully closed, and valve 1312-7 is fully open. This configuration of the wellhead assembly 1329 creates a flow path 1325-1 for the steam 1332 through the injection portion 1308 and a flow path 1325-2 for the production fluid 1341 through the production portion 1309. In this configuration, the flow path 1325-1 and the second flow path 1325-2 are independent of each other (e.g., do not intersect each other, do not overlap).

Under this configuration, the steam injection system 1330 sends steam 1332 through valve 1312-2, valve 1312-3, and valve 1312-4 (including associated piping 1388) of the injection portion 1308 of the wellhead assembly 1329, where the steam 1332 goes through the tubing spool/hanger assembly 1310 and any remaining wellhead assembly components 1305 to reach the cavity 1333 of the tubing string 1311. At the same time, also under this configuration, the production system 1335 receives the production fluid 1341 from the annulus 1323, through any remaining wellhead assembly components 1305, through the tubing spool/hanger assembly 1310, and through valve 1312-5 and valve 1312-7 (including associated piping 1388) of the production portion 1309 of the wellhead assembly 1329.

As discussed above, for example with respect to FIGS. 4 through 12, heavy oil (e.g., heavy oil 1392) has a relative high viscosity that causes a relatively small amount of heavy oil in a subterranean formation (e.g., subterranean formation 1327) to be produced without some form of enhancement. Also, as discussed above, one such enhancement is the injection of steam (e.g., steam 1332) into a wellbore (e.g., wellbore 1313). When the wellbore lacks multiple laterals, as with the wellbore 413 of FIGS. 4 through 12, there is often a period of time that lapses between when steam is injected and when production of the production fluid (e.g., production fluid 1341) begins so that the steam and the heavy oil have sufficient time to mix so that the viscosity of the resulting oil (e.g., oil 1393) is low enough to allow for sufficient quantities of the oil to be produced.

With the configuration of the wellbore 1313 of FIGS. 13A and 13B, with the lateral segment 1314-1 and the lateral segment 1314-2 being in fluidic communication with each other through fractures in the subterranean formation 1327, injection of steam 1332 and production of production fluids 1341 may be conducted simultaneously. Specifically, in this case, the steam 1332 that is injected through the cavity 1333 of the tubing string 1311 and through the isolated part (using the packers 1379) of the lateral segment 1314-1 into the subterranean formation 1327 interacts with the heavy oil 1392, resulting in oil 1393 having a relatively lower viscosity compared to that of the heavy oil 1392.

Due to the fluidic communication with the subterranean formation 1327 between lateral segment 1314-1 and lateral segment 1314-2, at least some of the oil 1393 may be produced through lateral segment 1314-2 as the steam 1332 is injected into lateral segment 1314-1. The production fluid 1341 that is produced through lateral segment 1314-2 and then the annulus 1323 before reaching the surface 1302 may be a mixture of the oil 1393, formation fluids 1395, and some of the heavy oil 1392 that may be produceable despite its relatively high viscosity.

In alternative embodiments, lateral segment 1314-2 may include the tubing string 1311 and the packers 1379, and lateral segment 1314-1 may be devoid of any of these components of the system 1300. In such cases, the steam 1332 may be injected into the subterranean formation 1327 from lateral segment 1314-2, and the production fluid 1341 may simultaneously be produced through lateral segment 1314-1.

Figure 14A:
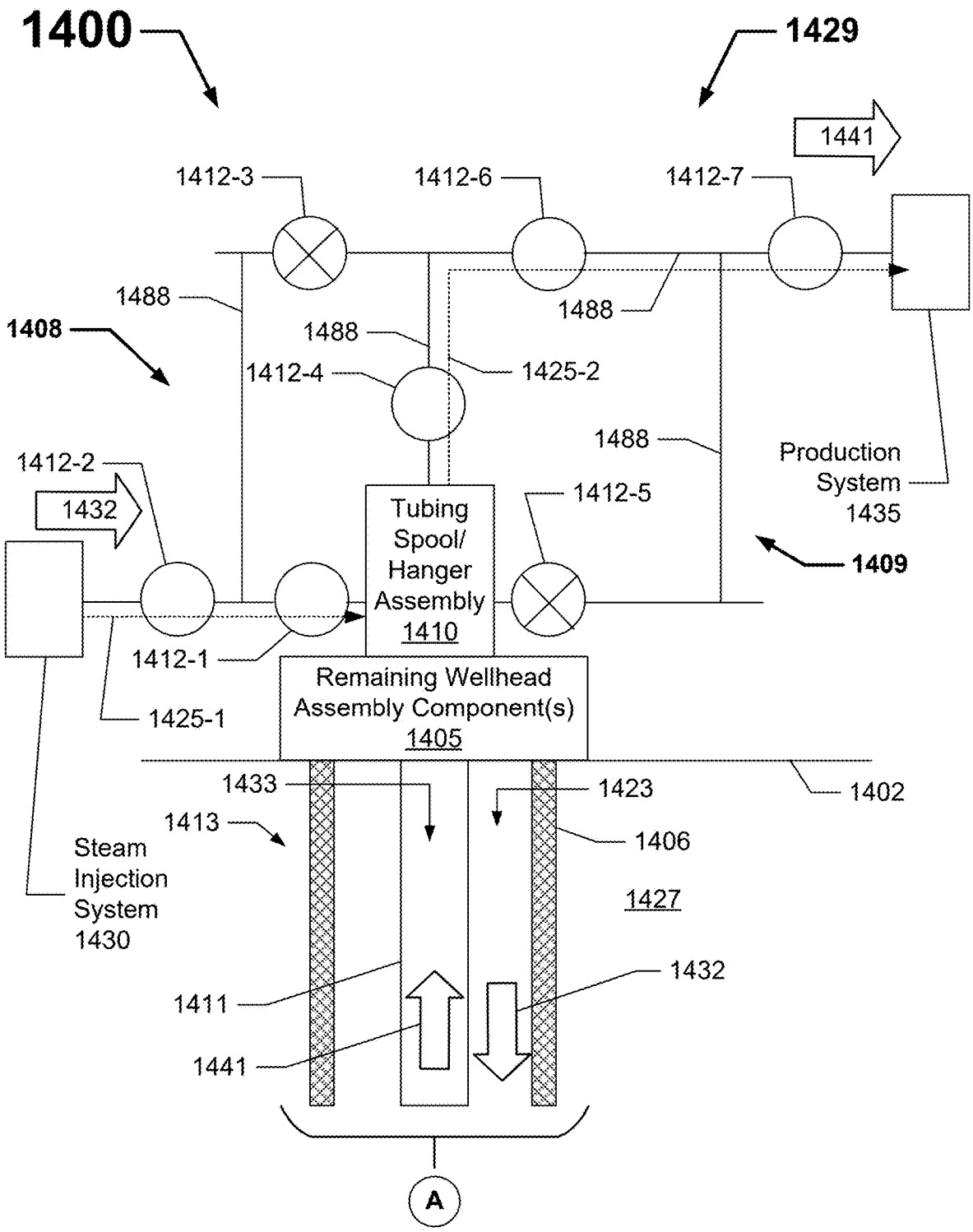
FIGS. 14A and 14B show another system that includes another example wellhead assembly used to perform simultaneous field operations on a wellbore with multiple lateral segments according to certain example embodiments.
Figure 14B:
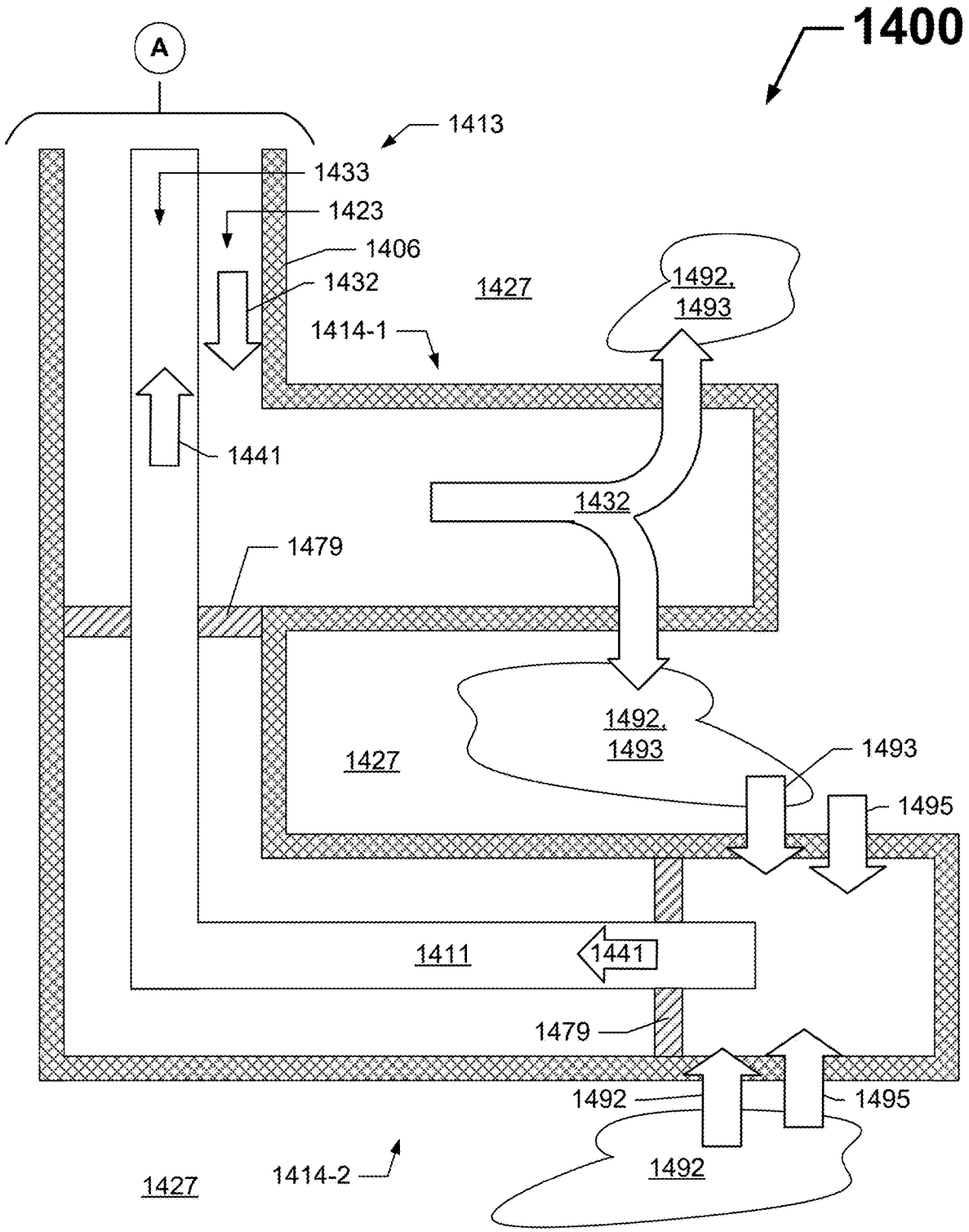

FIGS. 14A and 14B show another system 1400 that includes another example wellhead assembly 1429 used to perform simultaneous field operations on a wellbore 1413 with multiple lateral segments 1414 according to certain example embodiments. Referring to the description above with respect to FIGS. 1 through 13B, the system 1400 of FIGS. 14A and 14B includes the wellhead assembly 1429, a steam injection system 1430, a production system 1435, a wellbore 1413 drilled into a subterranean formation 1427 below the surface 1402, a production casing 1406 at the outer perimeter of the wellbore 1413, and a tubing string 1411 disposed within the production casing 1406. The tubing string 1411 has a cavity 1433 that runs along its length, and there is an annulus 1423 between the tubing string 1411 and the production casing 1406. The wellhead assembly 1429 includes seven valves 1412 (valve 1412-1, valve 1412-2, valve 1412-3, valve 1412-4, valve 1412-5, valve 1412-6, and valve 1412-7), a tubing spool/hanger assembly 1410, one or more remaining wellhead assembly components 1405, and piping 1488.

All of these components of the system 1400 of FIGS. 14A and 14B are substantially similar to the corresponding components of the system 100 discussed above with respect to FIG. 1, the system 400 discussed above with respect to FIGS. 4 through 12, and the system 1300 discussed above with respect to FIGS. 13A and 13B. For example, the wellhead assembly 1429 includes an injection portion 1408 and a production portion 1409. The injection portion 1408 includes valve 1412-1, valve 1412-2, valve 1412-3, valve 1412-4, and the piping 1488 that provides fluidic communication between these valves 1412, the steam injection system 1430, and the tubing spool/hanger assembly 1410. The production portion 1409 includes valve 1412-4, valve 1412-5, valve 1412-6, valve 1412-7, and the piping 1488 that provides fluidic communication between these valves 1412, the production system 1435, and the tubing spool/hanger assembly 1410. In this way, the valve 1412-4 is part of the injection portion 1408 and the production portion 1409.

There are no sensor devices (substantially similar to the sensor devices 160 of FIG. 1) shown in FIGS. 14A and 14B to make the drawings easier to follow, but in the field the wellhead assembly 1429 of the system 1400 of FIGS. 14A and 14B can include one or more sensor devices. The valves 1412 can sometimes be referred to as flow control valves 1412 herein. In some cases, valve 1412-4 can be omitted without adversely affecting the execution of the operational configurations shown in FIGS. 14A and 14B. Also, any users (e.g., users 151), associated user systems (e.g., user systems 155), controllers (e.g., controllers 104), other sensor devices (e.g., other sensor devices 260), network manager (e.g., network manager 180), communication links (e.g., communication links 186), power transfer links (e.g., power transfer links 187) are not shown in the systems of FIGS. 14A and 14B to simplify the drawings.

As discussed above, the wellbore 1413 of FIGS. 14A and 14B has two lateral segments 1414 (lateral segment 1414-1 and lateral segment 1414-2). While each lateral segment 1414 in this case is a substantially horizontal segment, and the two lateral segments 1414 are substantially parallel to each other. In alternative embodiments, one or both lateral segments 1414 may be non-horizontal. In addition, or in the alternative, lateral segment 1414-1 and lateral segment 1414-2 may be antiparallel with respect to each other. In any case, there is some amount of fluidic communication between lateral segment 1414-1 and lateral segment 1414-2 through fractures in the subterranean formation 1427.

In this case, the tubing string 1411 is inserted into the lateral segment 1414-2, and the annulus 1423 outside the lateral segment 1414-2 (as well as the vertical section of the wellbore 1413 below the lateral segment 1414-1) is isolated from the rest of the annulus 1423 (i.e., within the vertical section of the wellbore 1413 between the surface 1402 and the lateral segment 1414-1) by one or more (in this case, two) packers 1479. One or more packers 1479 may also be used to isolate the lateral segment 1414-1 (where steam 1432 is injected into the subterranean wellbore 1413) from the lateral segment 1414-2 (where production fluids 1441 are produced).

At the time captured in FIGS. 14A and 14B, the wellhead assembly 1429 of the system 1400 is configured so that injection of steam 1432 and production of production fluids 1441 occur simultaneously. Specifically, steam 1432 is injected down the annulus 1423 at the same time that production fluids 1441 are produced up the cavity 1433 of the tubing string 1411. For this to occur, valve 1412-1 is fully open, valve 1412-2 is fully open, valve 1412-3 is fully closed, valve 1412-4 is fully open, valve 1412-5 is fully closed, valve 1412-6 is fully open, and valve 1412-7 is fully open. This configuration of the wellhead assembly 1429 creates a flow path 1425-1 for the steam 1432 through the injection portion 1408 and a flow path 1425-2 for the production fluid 1441 through the production portion 1409. In this configuration, the flow path 1425-1 and the second flow path 1425-2 are independent of each other (e.g., do not intersect each other, do not overlap).

Under this configuration, the steam injection system 1430 sends steam 1432 through valve 1312-2 and valve 1312-1 (including associated piping 1388) of the injection portion 1408 of the wellhead assembly 1429, where the steam 1432 goes through the tubing spool/hanger assembly 1410 and any remaining wellhead assembly components 1405 to reach the annulus 1423. At the same time, also under this configuration, the production system 1435 receives the production fluid 1441 from the cavity 1433 of the tubing string 1411, through any remaining wellhead assembly components 1405, through the tubing spool/hanger assembly 1410, and through valve 1412-4, valve 1412-6, and valve 1412-7

(including associated piping 1488) of the production portion 1409 of the wellhead assembly 1429.

As discussed above, for example with respect to FIGS. 4 through 12, heavy oil (e.g., heavy oil 1492) has a relative high viscosity that causes a relatively small amount of heavy oil in a subterranean formation (e.g., subterranean formation 1427) to be produced without some form of enhancement. Also, as discussed above, one such enhancement is the injection of steam (e.g., steam 1432) into a wellbore (e.g., wellbore 1413). When the wellbore lacks multiple laterals, as with the wellbore 413 of FIGS. 4 through 12, there is often a period of time that lapses between when steam is injected and when production of the production fluid (e.g., production fluid 1441) begins so that the steam and the heavy oil have sufficient time to mix so that the viscosity of the resulting oil (e.g., oil 1493) is low enough to allow for sufficient quantities of the oil to be produced.

With the configuration of the wellbore 1413 of FIGS. 14A and 14B, with the lateral segment 1414-1 and the lateral segment 1414-2 being in fluidic communication with each other through fractures in the subterranean formation 1427, injection of steam 1432 and production of production fluids 1441 may be conducted simultaneously. Specifically, in this case, the steam 1432 that is injected through the annulus 1423 and through the lateral segment 1414-1 (which is isolated from the other downhole portions (e.g., the lateral segment 1414-2) of the wellbore 1413 by one or more packers 1479) into the subterranean formation 1427 interacts with the heavy oil 1492, resulting in oil 1493 having a relatively lower viscosity compared to that of the heavy oil 1492.

Due to the fluidic communication with the subterranean formation 1427 between lateral segment 1414-1 and lateral segment 1414-2, at least some of the oil 1493 may be produced through lateral segment 1414-2 (some of which may be isolated by one or more packers 1479) as the steam 1432 is injected into lateral segment 1414-1. The production fluid 1441 that is produced through lateral segment 1414-2 and then the cavity 1433 of the tubing string 1411 before reaching the surface 1402 may be a mixture of the oil 1493, formation fluids 1495, and some of the heavy oil 1492 that may be produceable despite its relatively high viscosity.

In alternative embodiments, the lateral segment 1414-1 may include the tubing string 1411 and the packers 1479, and the lateral segment 1414-2 may be devoid of any of these components of the system 1400. In such cases, the steam 1432 may be injected into the subterranean formation 1427 from lateral segment 1414-2, and the production fluid 1441 may simultaneously be produced through lateral segment 1414-1.

A similar strategy may be implemented with multiple wellbores using example embodiments. For example, when two wellbores have fluidic communication through fractures in the subterranean formation, the example wellhead assembly atop one wellbore may be configured to inject steam (e.g., through the annulus, through the cavity of the tubing string, through both the annulus and the cavity of the tubing string) into the wellbore while the example wellhead assembly atop another wellbore may be configured to produce production fluid (e.g., through the annulus, through the cavity of the tubing string, through both the annulus and the cavity of the tubing string) out of the other wellbore.

Figure 15:
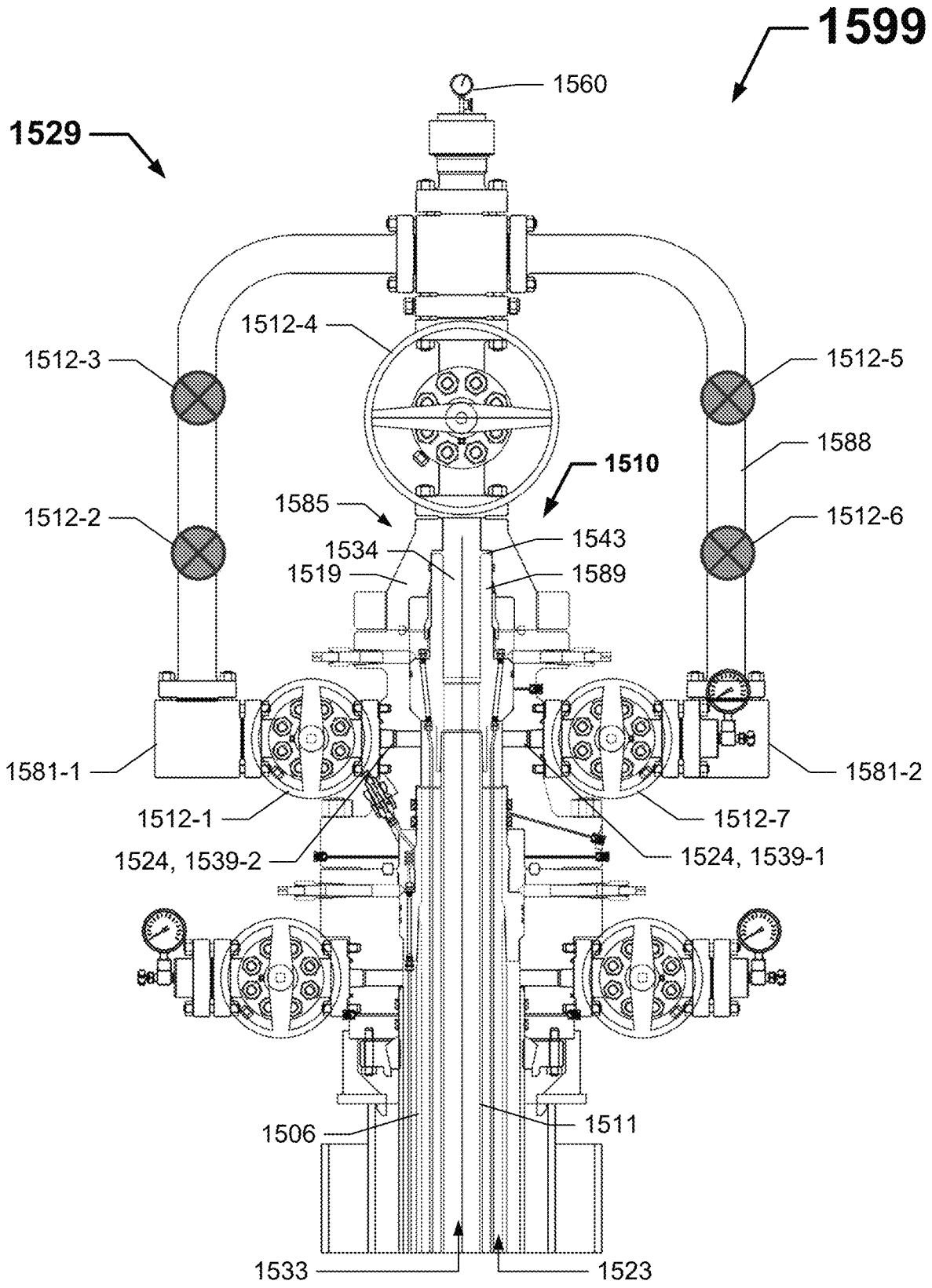
FIG. 15 shows a detailed sectional view of another tubing spool/hanger assembly according to certain example embodiments.

FIG. 15 shows a sectional view of a subassembly 1599 that includes a tubing spool/hanger assembly 1510 according to certain example embodiments. Referring to the description above with respect to FIGS. 1 through 14B, the subassembly 1599 of FIG. 15 includes a wellhead assembly 1529 that includes the tubing spool/hanger assembly 1510, the top part of a tubing string 1511, piping 1588, and seven valves 1512 (valve 1512-1, valve 1512-2, valve 1512-3, valve 1512-4, valve 1512-5, valve 1512-6, and valve 1512-7). The tubing spool/hanger assembly 1510 includes a tubing spool 1585 and a tubing hanger 1589. The wellhead assembly 1529, the tubing spool/hanger assembly 1510, the tubing string 1511, and the valves 1512 (also sometimes referred to as flow control valves 1512 herein) of FIG. 15 can be substantially the same as the wellhead assemblies, the tubing spool/hanger assemblies, the tubing strings, the piping, and the valves discussed above with respect to FIGS. 1 through 14B, except as described below.

In this case, the tubing spool/hanger assembly 1510 is part of the wellhead assembly 1529. The tubing hanger 1589 of the tubing spool/hanger assembly 1510 is substantially the same as tubing hangers currently known in the art. The tubing hanger 1589 is configured to be positioned within a cavity disposed in the bottom middle of the body 1519 of the tubing spool 1585. The tubing hanger 1589 couples to and supports the tubing string 1511. The tubing hanger 1589 has a cavity 1533 that runs continuously through the tubing hanger 1589 along the height of the tubing hanger 1589. The cavity 1533 has a diameter that is substantially the same as the inner diameter of the tubing string 1511. The top end of the cavity 1533 of the tubing hanger 1589 is configured to be in communication with a channel 1524 disposed in the body 1519 of the example tubing spool 1585. In this way, the channel 1524 provides a flow path for a fluid (e.g., steam 432, production fluid 441) between the cavity 1533 of the tubing hanger 1589 (and so also the tubing string 1511) and a system (e.g., a steam injection system 430, a production system 435).

The example tubing spool 1585 of the tubing spool/hanger assembly 1510 has a body 1519 with two channels (channel 1534 and channel 1524) and the cavity 1543 disposed therein. The channel 1534 within the body 1519 of the tubing spool 1585 intersects with the top end of the tubing hanger 1589 and the cavity 1533 that traverses therethrough. The channel 1534 is substantially horizontal and crosses through the body 1519 near the top end of the tubing spool 1585. The channel 1534 is defined, in part, by one or more walls in the body 1519 of the tubing spool 1585. In this example, the channel 1534 is substantially cylindrical in shape along its length.

The channel 1534 in the body 1519 of the tubing spool 1585 of FIG. 15 includes two side ends 1539. One side end 1539-1 extends from one side of the cavity 1543 (which also forms the top end of the annulus 1523). The side end 1539-2 of the channel 1524 provides a flow path for a fluid (e.g., steam 432, production fluid 441) between the annulus 1523 within a wellbore (e.g., wellbore 413) and a system (e.g., a steam injection system 430, a production system 435). Similarly, the side end 1539-1 of the channel 1524 provides a flow path for a fluid (e.g., production fluid 441, steam 432) between a wellbore (e.g., wellbore 413) and a system (e.g., a production system 435, a steam injection system 430).

The wellhead assembly 1529 of FIG. 15 includes two connector ends 1581 (connector end 1581-1 and connector end 1581-2) that provide for a physical connection to allow for fluidic communication between the wellhead assembly 1529 and a system (e.g., a production system 435, a steam injection system 430), including associated piping (e.g., similar to piping 1588). The configuration of the seven valves 1512 determine whether a particular system coupled to a connector end 1581 has no fluidic communication with the wellhead assembly 1529, has fluidic communication with the annulus 1523 (formed between the production casing 1506 and the tubing string 1511), and/or has fluidic communication with the cavity 1533.

The wellhead assembly 1529 may include one or more of a number of features that prevent the configuration of the seven valves 1512 from allowing two different systems (one system (e.g., a steam injection system 430) coupled to connector end 1581-1 and the other system (e.g., a production system 435) coupled to connector end 1581-2) from simultaneously having fluidic communication with the annulus 1523. In addition, or in the alternative, the wellhead assembly 1529 may include one or more of a number of features that prevent the configuration of the seven valves 1512 from allowing two different systems (one system (e.g., a steam injection system 430) coupled to connector end 1581-1 and the other system (e.g., a production system 435) coupled to connector end 1581-2) from simultaneously having fluidic communication with the cavity 1533. In this example, there is a sensor device 1560 (e.g., a pressure gauge, a flow meter) integrated with the piping 1588 and positioned above the valve 1512-4.

While not shown in FIG. 15, the wellhead assembly 1529 may include one or more of a number of other features and/or components. For example, the wellhead assembly 1529 of FIG. 15 may include one or more bypass valves (e.g., similar to the BPVs 236 of FIG. 3) As another example, the wellhead assembly 1529 of FIG. 15 may include one or more barriers (e.g., similar to the barriers 237 of FIG. 3).

Example embodiments can be used to independently configure and perform field operations (e.g., steam injection, production) with respect to the cavity of the tubing string and the annulus between the tubing string and the production casing. Example embodiments can include one or more BPVs to ensure safe operation by being able to isolate part of the wellbore. Example embodiments can be used with any of a number of field operations, including but not limited to steam injection, allowing soak time for the injected steam, and production of resulting lower viscosity oil and/or other subterranean resource. Example embodiments can provide a number of benefits. Such other benefits can include, but are not limited to, ease of use, reduction in costs, reduced need of certain equipment traditionally used for steam injection and production, configurability, time savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for utilizing steam for enhanced subterranean production, the method comprising:

operating a plurality of flow control valves of a wellhead assembly at a wellbore into a first configuration so that a first flow path of a plurality of flow paths is opened, wherein the first flow path comprises a first end and a second end, wherein the first end of the first flow path is configured to be coupled to a steam injection system, and wherein the second end of the first flow path is configured to be coupled to the wellbore that extends into a subterranean formation;

maintaining the first configuration of the plurality of flow control valves for a first time period, wherein the plurality of flow control valves and associated piping are configured to operate under a steam pressure, a steam temperature, and a steam flow rate present with injecting the steam for the first time period, and wherein the plurality of flow control valves and associated piping are further configured to operate under a production fluid pressure, a production fluid temperature, and a production fluid flow rate present with producing production fluid;

operating, after the first time period, the plurality of flow control valves of the wellhead assembly at the wellbore into a second configuration so that a second flow path is opened, wherein the second flow path comprises a first end and a second end, wherein the first end of the second flow path is configured to be coupled to the wellbore, and wherein the second end of the second flow path is configured to be coupled to a production system; and maintaining the second configuration of the plurality of flow control valves for a second time period, wherein at least one of the plurality of flow control valves is part of the first flow path during the first time period and the second flow path during the second time period.

2. The method of claim 1, wherein the first flow path is through an annulus between a tubing string and production casing.

3. The method of claim 1, wherein the first flow path is through a cavity within a tubing string.

4. The method of claim 1, wherein the first flow path is through a cavity within a tubing string and through an annulus between the tubing string and production casing.

5. The method of claim 1, further comprising:

operating, after the second time period, the plurality of flow control valves of the wellhead assembly at the wellbore into the first configuration so that the first flow path is reopened; and maintaining the first configuration of the plurality of flow control valves for a third time period.

6. The method of claim 1, wherein the second flow path is through an annulus between a tubing string and production casing.

7. The method of claim 1, wherein the second flow path is through a cavity within a tubing string.

8. The method of claim 1, wherein the second flow path is through a cavity within a tubing string and through an annulus between the tubing string and production casing.

9. The method of claim 1, wherein the second flow path is closed during the first time period.

10. The method of claim 1, wherein the first flow path is closed during the second time period.

11. The method of claim 1, wherein the first configuration of the plurality of flow control valves further opens a second flow path, wherein the second flow path comprises a first end and a second end, wherein the first end of the second flow path is configured to be coupled to the wellbore, and wherein the second end of the second flow path is configured to be coupled to a production system.

12. The method of claim 11, wherein the wellbore comprises a plurality of lateral portions having fluidic communication there between.

13. The method of claim 12, wherein the first flow path is through an annulus between a tubing string and production casing, wherein the second flow path is through a cavity within the tubing string, and wherein the tubing string extends into one of the plurality of lateral portions.

14. The method of claim 12, wherein the first flow path is through a cavity within a tubing string, wherein the second flow path is through an annulus between the tubing string and production casing, and wherein the tubing string extends into one of the plurality of lateral portions.

15. The method of claim 11, wherein the flow path and the second flow path are independent of each other.

16. The method of claim 1, wherein the steam is configured to combine with a heavy oil in the subterranean formation.

17. The method of claim 1, wherein the first flow path includes a flow control valve of the plurality of flow control valves that is used with an additional flow path through which the production fluid is produced.

18. The method of claim 1, wherein the plurality of flow control valves comprises a first flow control valve, a second flow control valve, a third flow control valve, a fourth flow control valve, a fifth flow control valve, a sixth flow control valve, and a seventh flow control valve.

19. A method for utilizing steam for enhanced subterranean production, the method comprising:

operating a plurality of flow control valves of a wellhead assembly at a wellbore into a first configuration so that a first flow path of a plurality of flow paths is opened, wherein the first flow path comprises a first end and a second end, wherein the first end of the first flow path is configured to be coupled to a steam injection system, and wherein the second end of the first flow path is configured to be coupled to the wellbore that extends into a subterranean formation; and maintaining the first configuration of the plurality of flow control valves for a first time period, wherein the plurality of flow control valves and associated piping are configured to operate under a steam pressure, a steam temperature, and a steam flow rate present with injecting the steam for the first time period, wherein the plurality of flow control valves and associated piping are further configured to operate under a production fluid pressure, a production fluid temperature, and a production fluid flow rate present with producing production fluid, wherein the first configuration of the plurality of flow control valves further opens a second flow path, wherein the second flow path comprises a first end and a second end, wherein the first end of the second flow path is configured to be coupled to the wellbore, and wherein the second end of the second flow path is configured to be coupled to a production system.

* * * * *